United States Patent [19]

Watanabe

[11] 4,238,984

[45] Dec. 16, 1980

[54] ELECTRONIC MUSICAL INSTRUMENT

[75] Inventor: Hironori Watanabe, Hamamatsu, Japan

[73] Assignee: Kabushiki Kaisha Kawai Gakki Seisakusho, Hamamatsu, Japan

[21] Appl. No.: 862,430

[22] Filed: Dec. 20, 1977

[30] Foreign Application Priority Data

| | | | |
|---|---|---|---|
| Dec. 20, 1976 | [JP] | Japan | 51-153107 |
| Dec. 20, 1976 | [JP] | Japan | 51-153108 |
| Dec. 20, 1976 | [JP] | Japan | 51-153109 |

[51] Int. Cl.[3] ..... G10H 1/00; G10H 1/02

[52] U.S. Cl. ..... 84/1.01; 84/1.26

[58] Field of Search ..... 84/1.01, 1.03, 1.13, 84/1.26, 1.19; 364/727

[56] References Cited

U.S. PATENT DOCUMENTS

| | | | |
|---|---|---|---|
| 3,809,786 | 5/1974 | Deutsch | 84/1.01 |
| 3,823,390 | 7/1974 | Tomisawa et al. | 84/1.01 |
| 3,899,951 | 8/1975 | Griffith et al. | 84/1.01 |
| 3,971,284 | 7/1976 | Schreier | 84/1.26 |
| 3,981,217 | 9/1976 | Oya | 84/1.03 |
| 4,090,426 | 5/1978 | Luce | 84/1.26 |

OTHER PUBLICATIONS

Millman and Halkias, *Integrated Electronics,* McGraw-Hill, 1972, pp. 661-665.

*Primary Examiner*—J. V. Truhe
*Assistant Examiner*—Forester W. Isen

[57] ABSTRACT

An electronic musical instrument which produces musical notes synthesized based on logic orthogonal functions stored in digital form. A coefficient corresponding to a tone selected by a tone selector is read out of a memory to calculate a logic orthogonal function, for example, a composite coefficient of a Walsh Hadamard matrix. The composite coefficient is applied to a plurality of waveshape calculators to calculate the amplitude value of a waveshape of the required tone and the waveshape calculators are actuated at the timing predetermined times the period of the musical note selected by the depressed key. Any desired musical waveshape can be produced by setting the coefficient corresponding thereto and the spectral structure of the waveshape can be changed with the lapse of time. Polyphonic tone synthesis is achieved by intermittent operation of the waveshape calculators to produce a wide variety of musical sounds. Further, a depressed key data detector is provided for detecting non-encoded key data. Columns of a key switch matrix are selected by a ring counter and a predetermined time slot is provided by a priority selector in accordance with priority of rows having key switch closure signals and a pulse having the phase angle of the row is produced in the time slot. This pulse is extracted together with a frame pulse and a clock to detect key data. The key data are assigned to a plurality of assignment units one after another and, thereafter, waveshape calculation is carried out in each of a plurality of systems.

11 Claims, 18 Drawing Figures

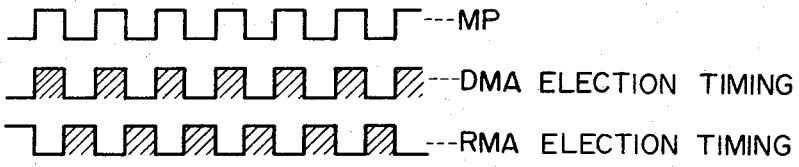
FIG. 2
FIG. 11
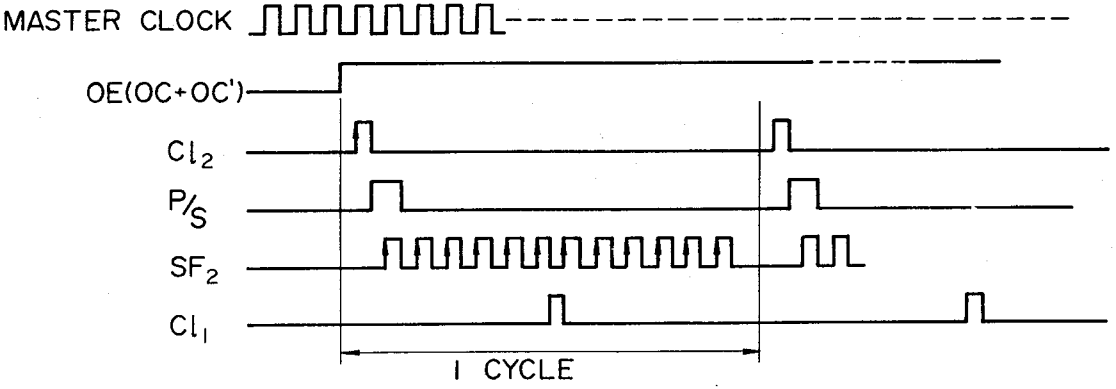

ELECTRONIC MUSICAL INSTRUMENT

BACKGROUND OF THE INVENTION

1. Field of the Invention

This invention relates to an electronic musical instrument which synthesizes musical sounds, using logic orthogonal functions stored in digital form.

2. Description of the Prior Art

Typical examples of conventional electronic musical instruments employing the digital techniques are set forth in U.S. Pat. Nos. 3,515,792 and 3,809,786, in which their advantages are also referred to in brief as compared with prior art electronic musical instruments using the analog techniques.

In the abovesaid U.S. Pat. No. 3,515,792, amplitude values of the waveshape of a pipe organ tone or other instrument sound are quantized digitally at a plurality of sample points and stored in a fixed memory and the memory is repetitively read out at a rate determined by the note selected on the keyboard to obtain a digital representation of the selected musical note. After attack, release and other tone amplitude modulation effects are provided digitally, the musical note is converted to analog form for input to a sound system.

Further, for polyphonic tone synthesis, this system is constructed to use the abovesaid memory on a time shared basis to produce musical sounds selected by a plurality of keys.

The most serious defect of this system is the difficulty in producing a change of the spectral construction of a waveshape with the lapse of time which is desirable in terms of hearing sensation. In other words, the musical notes generated are limited only to the waveshapes read out of the fixed memory, and accordingly it is impossible to obtain a wide variety of tonal changes of ordinary instrument sounds having ever-changing tones.

The system disclosed in the other U.S. Pat. No. 3,809,786 solves many of the problems encountered in the abovesaid system. The basic structure of this system is to represent in digital form stored harmonic coefficients and a frequency selected by a key; to individually calculate Fourier components of respective moments in real time while establishing the waveshape period of the selected musical note; to sum them to digitally calculate the amplitude of the musical note of a specified time; and to reproduce the musical note to a sound.

That is, the use of a method of producing musical note by the employment of a Fourier algorithm not only settles the problems of the aforesaid system but also provides a system having a high degree of freedom which allows ease in acoustic manipulation of various musical notes. In this system, however, a system of sine wave orthogonal functions is used for Fourier inverse transformation. The system of sine wave orthogonal functions is a system of orthogonal functions in analog form and even if quantized and encoded, their values must be represented by a certain word length. This means the necessity of using a relatively large multiplier for multiplying the harmonic coefficient and each harmonic. For example, in case each harmonic amplitude and the harmonic coefficient are represented by n and m bits, a multiplication of $n \times m$ bits is required, which increases the number of elements forming the multiplier in parallel calculation and increases the calculation time in serial calculation.

In a device which has a large number of key switches, such as the keyboard of an electronic musical instrument, direct connection of the key switches to internal circuits for transferring information on the opening and closure of the switches to a desired one of the circuits inevitably involves an enormous amount of wiring, and hence is uneconomical. Also, the use of semiconductor integrated circuits or the like is difficult because of too large a number of pins.

In view of the above, there has recently been proposed a system which scans all key switches in a predetermined period of time and generates a pulse at the moment corresponding to a closed one of the key switches for each time sequence of the scanning, thereby to save the amount of wiring between the key switches and required circuits. For example, a key code multiplex system is usually employed in which information of a closed key switch detected by scanning the key switches on a time shared basis is sent in the form of a TDM (Time Division Modulation) or PCM (Pulse Code Modulation) signal. With this system however, the time for scanning all the key switches is fixed and this fixed scanning time is always required regardless of the number of key switches being closed, so that the scanning time is consumed wastefully in some cases.

The maximum number of keys which can be depressed simultaneously with both hands and a foot in the playing of an ordinary keyboard instrument is eleven. Assuming that blocks into which the keys are divided each correspond to one octave, it is impossible to depress the keys of two or more octaves with one hand, and accordingly the maximum number of block simultaneously occupied is five. Accordingly, the key switches are scanned for each block of them and if a key switch or switches are closed, the scanning is stopped for detecting them. Since the scanning is not stopped in the block having no key switch closed, one scanning time for obtaining switch information can be shortened.

The present applicants have proposed in the copending U.S. application Ser. No. 834,427 entitled "Electronic Musical Instrument" a key code generator of the variable frame method which shortens the scanning time in accordance with the abovesaid principle. Further, the present applicants have made a similar proposal in a different application recently filed. The outputs produced in the these systems are encoded, in which case the detection and assignment of depressed key data are very easy. On the other hand, in an electronic musical instrument of the type producing musical notes based on coefficient values of logic orthogonal functions described later, which has been proposed in our another application also recently filed, there is adopted, for simplification of the structure and processing, a method in which a plurality of non-encoded key data produced by simultaneous depression or releasing of a plurality of keys are assigned by an assignment unit and, thereafter, the addition of an envelope and a waveshape calculation are carried out in a plurality of systems. The detection and assignment of the depressed key data in this case present problems.

SUMMARY OF THE INVENTION

An object of this invention is to provide an electronic musical instrument system which adds spectrum variations to a musical note in terms of time, using logic orthogonal functions.

Another object of this invention is to provide an electronic musical instrument which digitally produces a musical note of variegated changes with a simplified structure.

Another object of this invention is to provide an electronic musical instrument which is provided with a depressed key data detection and assignment unit capable of efficient detection and assignment of key data by the employment of the variable frame method.

Still another object of this invention is to provide an electronic musical instrument which is provided with a simple-structured and miniaturized envelope generator for a plurality of systems of envelope addition.

BRIEF DESCRIPTION OF THE DRAWINGS

FIG. 2 is a diagram explanatory of timings used in the embodiment of this invention;

FIGS. 9 to 12 show waveforms for the operation of the depressed key data detector used in FIG. 7;

DESCRIPTION OF THE PREFERRED EMBODIMENTS

Figure 1:
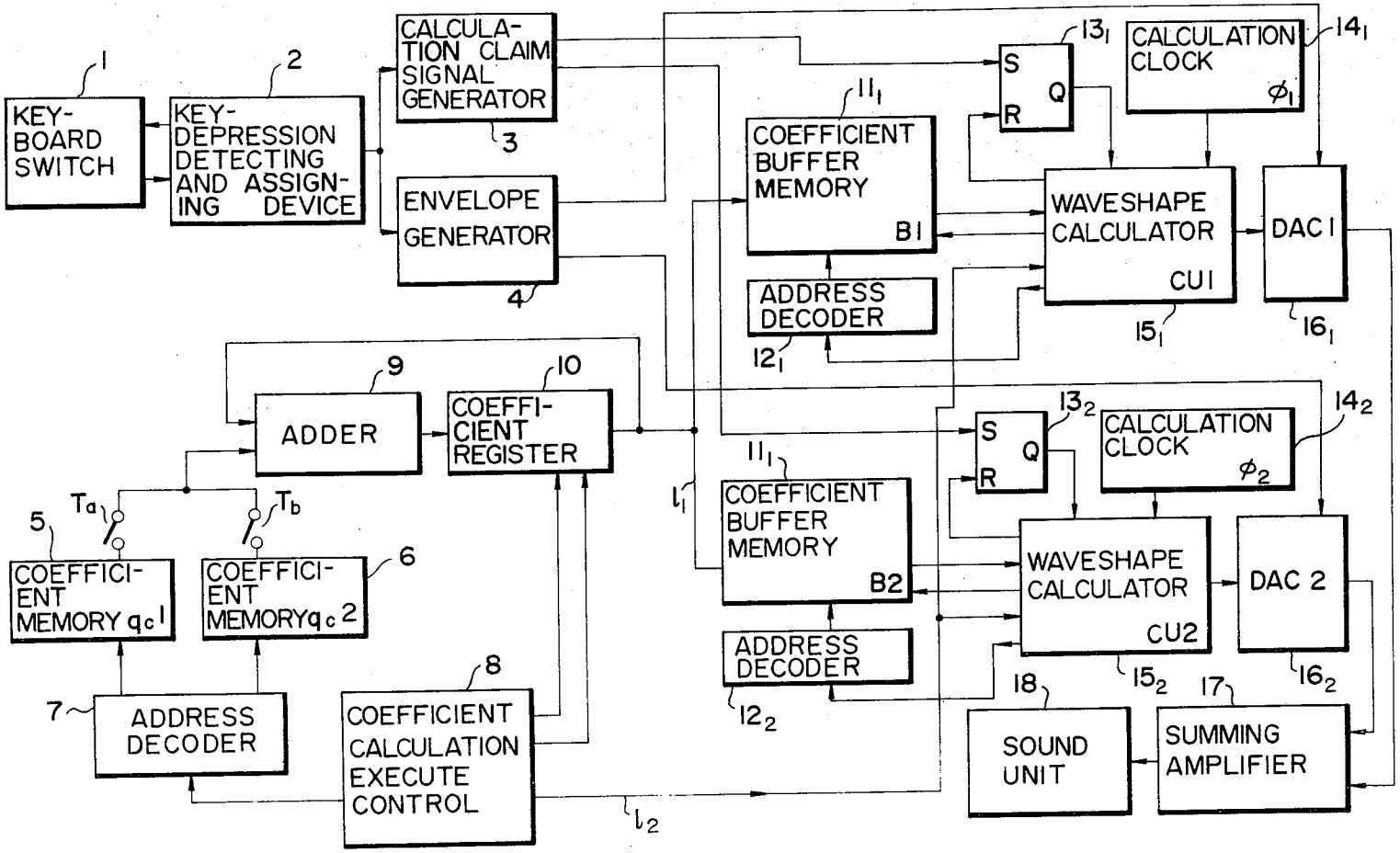
FIG. 1 is a block diagram illustrating the construction of an embodiment of this invention.

The principles and embodiments of this invention will hereinafter be described in detail.

A description will be given of the principles of the invention. The musical note synthesizing method of this invention is to calculate, in accordance with a predetermined program, digital sample values representing musical waveshape amplitudes from stored coefficients for logic orthogonal functions.

Generally, systems of logic orthogonal functions are well-known as systems of orthogonal functions taking two values (+1 and −1) which is suitable for a digital circuit, as against such systems of sine wave orthogonal functions or complex exponent orthogonal functions which take analog values. This invention adopts the Walsh Hadamard matrix which is one of the systems of logic orthogonal functions. The Walsh Hadamard matrix is the system of orthogonal functions that a natural Hadamard matrix is subjected to row permutation, and that row vector components are arranged in an ascending order of the number of changes of the sign. For example, an 8-degree Walsh Hadamard matrix $[H_8]$ is expressed as follows:

$$[H_8] = \begin{bmatrix} + & + & + & + & + & + & + & + \\ + & + & + & + & - & - & - & - \\ + & + & - & - & - & - & + & + \\ + & + & - & - & + & + & - & - \\ + & - & - & + & + & - & - & + \\ + & - & - & + & - & + & + & - \\ + & - & + & - & - & + & - & + \\ + & - & + & - & + & - & + & - \end{bmatrix} \quad (1)$$

where + is +1 and − is −1.

In this invention, the waveshape amplitude is calculated by inverse conversion from the coefficient value for the orthogonal functions (an orthogonal matrix). The conversion and inverse conversion by the Walsh Hadamard matrix has the property that they can be achieved by the same matrix calculation and the property of having a spectrum resolving function in the range from generalized low-frequency components to high-frequency ones that the components of less to more changes can be expressed as coefficients for the row vectors. This invention is constructed so that, when to calculate the waveshape amplitudes, the coefficients for the respective row vectors are programatically scaled to change the spectra of musical notes produced at every moment, thereby generating musical sounds quite agreeable to the ear.

As described above, the system of logic orthogonal functions such as the Walsh Hadamard matrix is the system of functions which takes two values of +1 and −1, and the calculation of the coefficient and the row vector can be accomplished by addition and subtraction and can be achieved substantially by an exclusive OR gate. This permits of remarked simplification of the scale of the device for the inverse conversion of the waveshape amplitude.

A detailed explanation of the logic orthogonal functions is given, for example, "Walsh Function" by Tsugihiko Kato, the Institute of Electronics and Communication Enginners of Japan, data of the society for the study of non-linearity problem (Date NLP 70–14).

On the other hand, the musical period peculiar to the electronic musical instrument is established by applying a predetermined clock to a calculation device having a function of high-speed calculation of the waveshape amplitude value with a fixed clock to actuate the calculator periodically intermittently. The structure of the type actuating the calculator with a clock of a frequency a predetermined times the musical period must be so designed as to actuate the calculator over a relatively wide frequency range. This imposes a burden on the design of a calculation timing circuit.

That is, the calculation device is so programmed or formed with hardware for its exclusive use as to calculate and output at least one waveshape amplitude in digital form upon each input of a calculation claim signal and to stop the calculation processing until input of the next calculation claim signal. The moment of generation of the calculation claim signal is set by the key switch and this signal is generated with a period predetermined times (for instance, 1/64) the period of the musical note corresponding to a selected key. Accordingly, the waveshape calculator is constructed to carry out a relatively high-speed calculation so that when supplied with the calculation claim signal, the calculator calculates the waveshape amplitude in digital form in accordance with a predetermined program but finishes the calculation before occurrence of the next calculation claim signal. Further, a plurality of such waveshape calculators are employed for polyphonic tone synthesis.

FIG. 1 is a block diagram illustrating an embodiment of this invention in accordance with the principles described above.

In FIG. 1, a depressed or released key signal from a keyboard switch 1 is applied to a key depression detecting and assigning device 2, which detects the key signal, assigns a waveshape calculator to be used, controls the application of a calculation claim signal to the waveshape calculator and controls an envelope generator for achieving amplitude modulation of a calculated waveshape such as attack, release and so on.

An assignment and control signal from the key depression and assignment device 2 is applied to a calculation claim signal generator 3 to supply therefrom a calculation claim signal to the waveshape calculator with a period predetermined times the musical sound period corresponding to the selected key. An envelope control signal from the key depression detecting and assigning device 2 is applied to an envelope generator 4 to generate an envelope waveshape for obtaining attack, release and other amplitude modulation effects of a musical sound produced corresponding to key depression or release. In the present embodiment, this envelope waveshape is provided in the form of an analog quantity and is used for simulating attack, release and other amplitude modulation of a musical sound which is produced by controlling a unit quantizing voltage with the abovesaid envelope when the output from the waveshape calculator described later, that is, a musical waveshape of digital form, is converted to analog form.

In a coefficient calculation part which is the principal part of this invention, there are provided coefficient memories (qcl) 5 and (qc2) 6, which have stored therein in digital form coefficient values for respective row vectors of a Walsh Hadamard matrix for the calculation of a desired musical waveshape. The contents of the coefficient memories 5 and 6 are read out by a coefficient calculation execute control 8 via an address decoder 7. The contents of the coefficient memories 5 and 6 are respectively read out into an adder 9 and added with a pair of coefficients selected by tone tablets Ta and Tb of a tone selector, providing a pair of coefficients, that is, a composite coefficient. For instance, when the tone tablets Ta and Tb are closed, the coefficients of the coefficient memories 5 and 6 are read out and the sum is calculated for each row vector component of the Walsh Hadamard matrix and planted in a coefficient register 10. A first operation of calculating the composite coefficient in accordance with the state of the tone tablets Ta and Tb using the adder 9 and the coefficient register 10 and a second operation of transferring the calculated result to coefficient buffer memories (B1) $\mathbf{11}_1$ and (B2) $\mathbf{11}_2$ of the next stage are controlled by the coefficient calculation execute control 8. The two operations are repetitiously carried out. The result of calculation thus obtained in the coefficient register 10 is written in the coefficient buffer memories $\mathbf{11}_1$ and $\mathbf{11}_2$ provided corresponding to waveshape calculators (CU1) $\mathbf{15}_1$ and (CU2) $\mathbf{15}_2$, respectively. In the coefficient buffer memories $\mathbf{11}_1$ and $\mathbf{11}_2$, read and write are achieved on a time shared basis in two times, i.e. the timing for writing the composite coefficient of the coefficient register 10 and the timing for reading out the written composite coefficient at the request of the waveshape calculators $\mathbf{15}_1$ and $\mathbf{15}_2$.

The waveshape calculators $\mathbf{15}_1$ and $\mathbf{15}_2$ are calculators which digitally calculate the musical waveshape amplitude at the calculation timings of calculation clocks ($\phi_1$) $\mathbf{14}_1$ and ($\phi_2$) $\mathbf{14}_2$ on the basis of the data from the coefficient buffer memories $\mathbf{11}_1$ and $\mathbf{11}_2$, and each intermittently execute the calculation in reply to a calculation claim signal. The present embodiment is shown to employ the two waveshape calculators $\mathbf{15}_1$ and $\mathbf{15}_2$ to enable the musical sound generation in response to two depressed keys, but the number of the waveshape calculators can be increased as required.

For providing the timing of the intermittent operation to ensure the stopping and execution of the waveshape calculators $\mathbf{15}_1$ and $\mathbf{15}_2$, flip-flops $\mathbf{13}_1$ and $\mathbf{13}_2$ are provided, which are each set by the calculation claim signal from the calculation claim signal generator 3, and the waveshape calculators are each controlled by the Q output from each flip-flop. The flip-flops $\mathbf{13}_1$ and $\mathbf{13}_2$ are respectively reset by signals indicative of completion of the predetermined calculation of completion of the predetermined calculation of the waveshape calculators $\mathbf{15}_1$ and $\mathbf{15}_2$.

Under the control of the waveshape calculators $\mathbf{15}_1$ and $\mathbf{15}_2$, the coefficient buffer memories $\mathbf{11}_1$ and $\mathbf{11}_2$ are read out via address decoders $\mathbf{12}_1$ and $\mathbf{12}_2$, respectively.

The digital outputs from the waveshape calculators $\mathbf{15}_1$ and $\mathbf{15}_2$ are respectively applied to D-A converters (DAC1) $\mathbf{16}_1$ and (DAC2) $\mathbf{16}_2$ for conversion to analog quantities, which are respectively added with the envelope output from the envelope generator 4, as described above. It is desirable that the D-A converters $\mathbf{16}_1$ and $\mathbf{16}_2$ are multiplication type D-A converters in which the unit quantizing step voltage is variable. The outputs from the D-A converters $\mathbf{16}_1$ and $\mathbf{16}_2$ are provided via a summing amplifier 17 to a sound unit 18 for production of the musical note.

The above is the outline of the embodiment of this invention and its principal part will hereinafter be described in more detail.

Now, n coefficients $x_l$ to $x_n$ and $y_l$ to $y_n$ for the Walsh Hadamard matrix are stored in the coefficient memories 5 and 6, respectively. Let it be assumed that $n=2^x$ ($x=1, 2, \ldots$) and that the tone tablets Ta and Tb are closed.

The coefficient calculation execute control 8 first clears the coefficient register 10 and then plants the content of the coefficient memory 5 in the coefficient register 10 via the adder 9. The coefficient register 10 may preferably be a shift register and its output is applied to the adder 9. The adder 9 and the coefficient register 10 essentially form an accumulator. Upon completion of planting the content of the coefficient memory 5, the coefficient calculation execute control 8 reads out the content of the coefficient memory 6 and, at the same time, sequentially shifts the coefficient register 10 in synchronism with the readout to calculate composite coefficient $Z_l$ to $Z_n$ for respective row vectors. That is, $x_1+y_1=Z_1$, $x_2+y_2=Z_2$, . . . $x_n+y_n=Z_n$. Accordingly, when the contents of the coefficient memories have all been read out, the composite coefficients $Z_1$ to $Z_n$ are planted in the coefficient register 10. Thus, the aforesaid first operation is completed and then the results of the calculation are sent to the coefficient buffer memories $\mathbf{11}_1$ and $\mathbf{11}_2$.

At this time, the coefficient calculation execute control 8 provides via a line $l_2$ to the waveshape calculators $\mathbf{15}_1$ and $\mathbf{15}_2$ a synchronizing signal DMA indicating the read-out state of the coefficient buffer memories $\mathbf{11}_1$ and $\mathbf{11}_2$, a single MP discriminating the two periods of the coefficient buffer memories $11_1$ and $11_2$ from each other, that is, the period for writing and the period for reading, and a signal BW identifying the second operation of the coefficient register 10, that is, indicating whether or not the composite coefficients are being transferred. The composite coefficients are applied via a line $l_1$ to the coefficient buffer memories $11_1$ and $11_2$, respectively. The coefficient buffer memories $11_1$ and $11_2$ each perform different operations in two periods of time.

FIG. 2 shows the timing relationships of the above-mentioned signals MP and DMA and a coefficient read signal RMA to one another. The signal MP periodically takes the values "1" and "0" at high speed to provide a first timing for writing and a second timing for reading. The synchronizing signal DMA assigns at the second timing the address of the coefficient buffer memory 11 through a data selector 31 of the waveshape calculator 15 shown in FIG. 3, which is actuated by the signal MP, and through an address decoder 12 for storing the composite coefficients from storing the composite coefficients from the coefficient register 10 at predetermined addresses in the coefficient buffer memories $11_1$ and $11_2$. If the composite coefficients are being transferred, the signal BW takes the value "1" to make a write signal become "1" through an AND circuit 32, with the result that new coefficients are written in predetermined addresses at the first timing. On the other hand, the coefficients for the waveshape calculation are selectively read out by the read signal RMA from a calculation execute program control 34 at the second timing.

Figure 3:
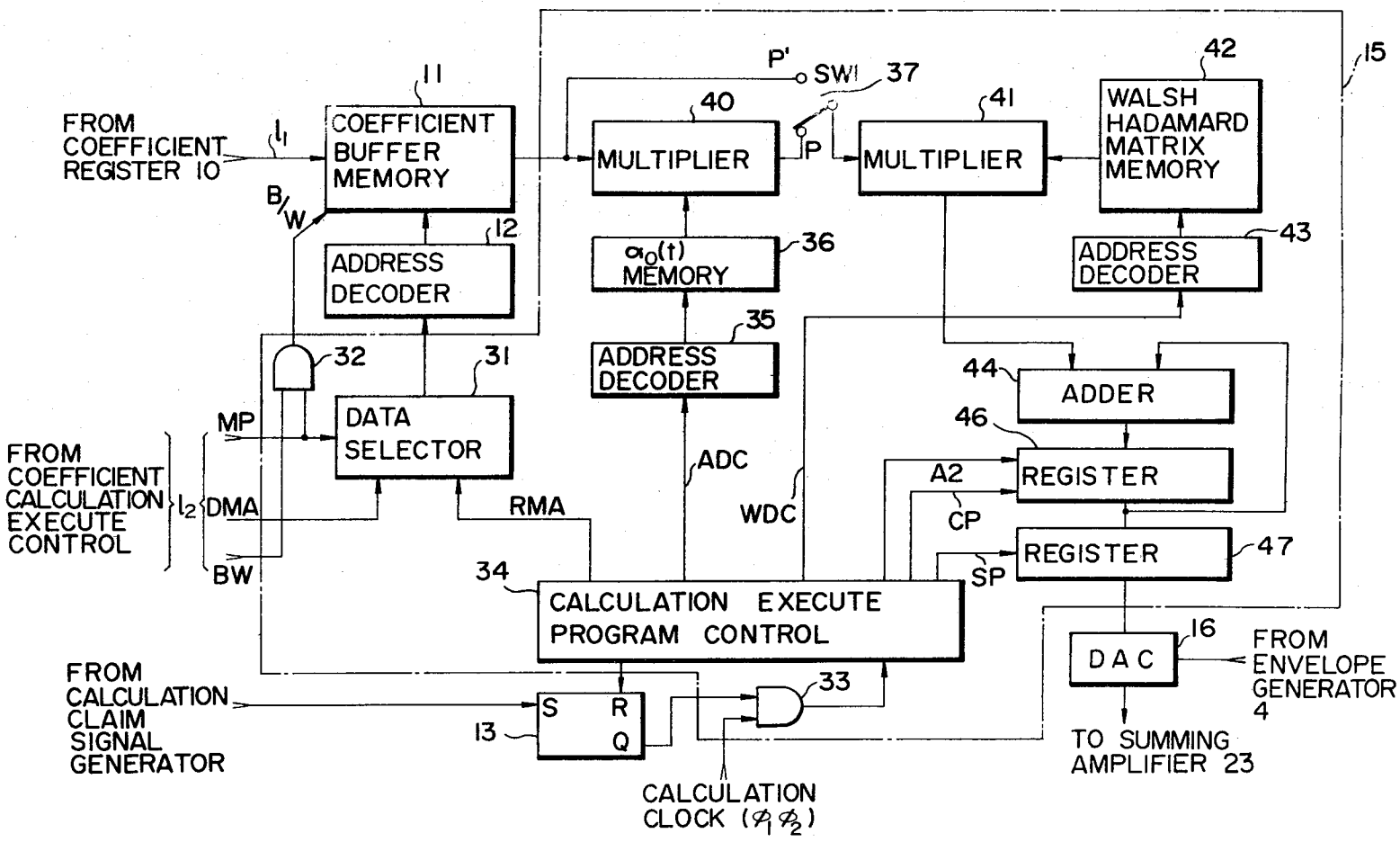
FIG. 3 is a block diagram showing in detail the principal part of the embodiment of FIG. 1.

In FIG. 3 there is shown in detail an example of the circuit structure of the waveshape calculator 15 ($15_1$, $15_2$). The following waveshape calculation is achieved using the composite coefficient read out of the coefficient buffer memory 11 but, for providing musical intervals, the calculation clock is inhibited by the flip-flop 13 to intermittently carry out the waveshape calculation, calculating the musical waveshape amplitude in digital form.

A description will be given of two methods of calculating the musical waveshape with the waveshape calculator employing the Walsh Hadamard matrix. The principle of a first one of the calculation methods and its example will be described first.

An n-degree Walsh Hadamard matrix is expressed by the following equation.

$$[H_n]=[h_{ij}:i,\ j=1,\ 2,\ \ldots\ n] \tag{2}$$

where $h_{ij}=+1$ or $-1$. Waveshape amplitudes $S_1, S_2, \ldots S_n$ which are calculated when the composite coefficients are taken as $Z_1, Z_2, \ldots Z_n$, are obtained by the following matrix calculation.

$$\begin{bmatrix} S_1 \\ S_2 \\ \cdot \\ \cdot \\ \cdot \\ S_n \end{bmatrix} = \begin{bmatrix} h_{11} & \ldots & h_{1n} \\ \cdot & & \cdot \\ \cdot & & \cdot \\ \cdot & & \cdot \\ \cdot & & \cdot \\ h_{n1} & \ldots & h_{nn} \end{bmatrix} \tag{3}$$

At this time, the composite coefficients $Z_1, Z_2, \ldots Z_n$ are subjected to scaling in terms of time. That is, if scaling values given in the form of time functions are represented by $\alpha_n(t)$ corresponding to the composite coefficients $Z_1$ to $Z_n$, the coefficients are respectively multiplied to provide $\alpha_1(t)Z_1, \alpha_2(t)Z_2, \ldots \alpha_n(t)Z_n$, by which the spectrum structure of a generated musical note is made variable. This brings about a variety of tonal changes in terms of hearing sensation.

The following is the equation for carrying out the multiplication corresponding to the equation (3).

$$\begin{bmatrix} S_1 \\ S_2 \\ \cdot \\ \cdot \\ \cdot \\ S_n \end{bmatrix} = \begin{bmatrix} h_{11} & \ldots & h_{1n} \\ \cdot & & \cdot \\ \cdot & & \cdot \\ \cdot & & \cdot \\ \cdot & & \cdot \\ h_{n1} & & h_{nn} \end{bmatrix} \begin{bmatrix} \alpha_1(t)Z_1 \\ \alpha_2(t)Z_2 \\ \cdot \\ \cdot \\ \cdot \\ \alpha_n(t)Z_n \end{bmatrix} \tag{4}$$

Referring to FIG. 3, a description will be made of the procedure for calculating the musical waveshape by the method shown by the equation (4). Upon generation of a calculation claim signal, the flip-flop 13 is set to provide calculation clocks ($\phi_1$ and $\phi_2$) via an AND circuit 33 to the calculation execute program control 34. In this instance, the calculation is always carried out at the second timing.

At first, the calculation execute program control 34 reads out the coefficient $Z_1$ with the read signal RMA and, further, reads out $\alpha_1(t)$ from a memory 36 with a read control signal ADC of the time function $\alpha_n(t)$ via an address decoder 35 for input to a multiplier 40, in which a multiplication of $\alpha_1(t)Z_1$ is carried out. At the same time, the calculation execute program control 34 applies a control signal WDC via an address decoder 43 to a Walsh Hadamard matrix memory 42 to read out therefrom the coefficient $h_{11}$ for input to a multiplier 41 to calculate $\alpha_1(t)Z_1h_{11}$. Since the coefficient $h_{ij}$ takes either one of the values $+1$ and $-1$, the multiplier 41 may be essentially a complementer or exclusive OR gate and the purpose can be attained with a very small number of gates used. The multiplied output $\alpha_1(t)Z_1h_{11}$ from the multiplier 41 is planted in a register 46 via an adder 44. Next, the calculation execute program control 34 reads out $Z_2$, $\alpha_2(t)$ and $h_{12}$ with the signals RMA, ADC and WDC, respectively, to calculate $\alpha_2(t)Z_2h_{12}$, which is applied to the adder 44 and added to $\alpha_1Z_1h_{11}$ previously calculated. The added output from the adder 44 is planted in the register 46. In this manner, $$h_{11}\alpha_1(t)Z_1+h_{12}\alpha_2(t)Z_2+\ldots+h_{1n}\alpha_n(t)Z_n \tag{5}$$

is sequentially calculated to obtain a first sample point $S_1$ of the waveshape amplitude generated. Then, $S_1$ is planted in a register 47 and its output is converted by the D-A converter 16 to an analog form.

Next, the calculation execute program control 34 clears the register 46 and, at the same time, resets the flip-flop 13 to temporarily stop the calculation and maintains this state until the next calculation claim signal is generated. That is, each time the calculation claim signal is provided, one waveshape sample value is calculated.

The following table shows the execution process of the calculation which is carried out in reply to the calculation claim signal $\tau_k$(k=1,2,3 . . . ).

$$\left.\begin{array}{ll} \tau_1 & S_1 = h_{11}\alpha_1(t)Z_1 + h_{12}\alpha_2(t)Z_2 \ldots + h_{1n}\alpha_n(t)Z_n \\ \tau_2 & S_2 = h_{21}\alpha_1(t)Z_1 + h_{22}\alpha_2(t)Z_2 \ldots + h_{2n}\alpha_n(t)Z_n \\ \cdot & \cdot \\ \cdot & \cdot \\ \cdot & \cdot \\ \tau_n & S_n = h_{n1}\alpha_1(t)Z_1 + h_{n2}\alpha_2(t)Z_2 \ldots + h_{nn}\alpha_n(t)Z_n \\ \tau_{n+1} & S_{n+1} = h_{11}\alpha_1(t)Z_1 + h_{12}\alpha_2(t)Z_2 \ldots + h_{1n}\alpha_1(t)Z_n \end{array}\right\} \tag{6}$$

-continued

Figure 4:
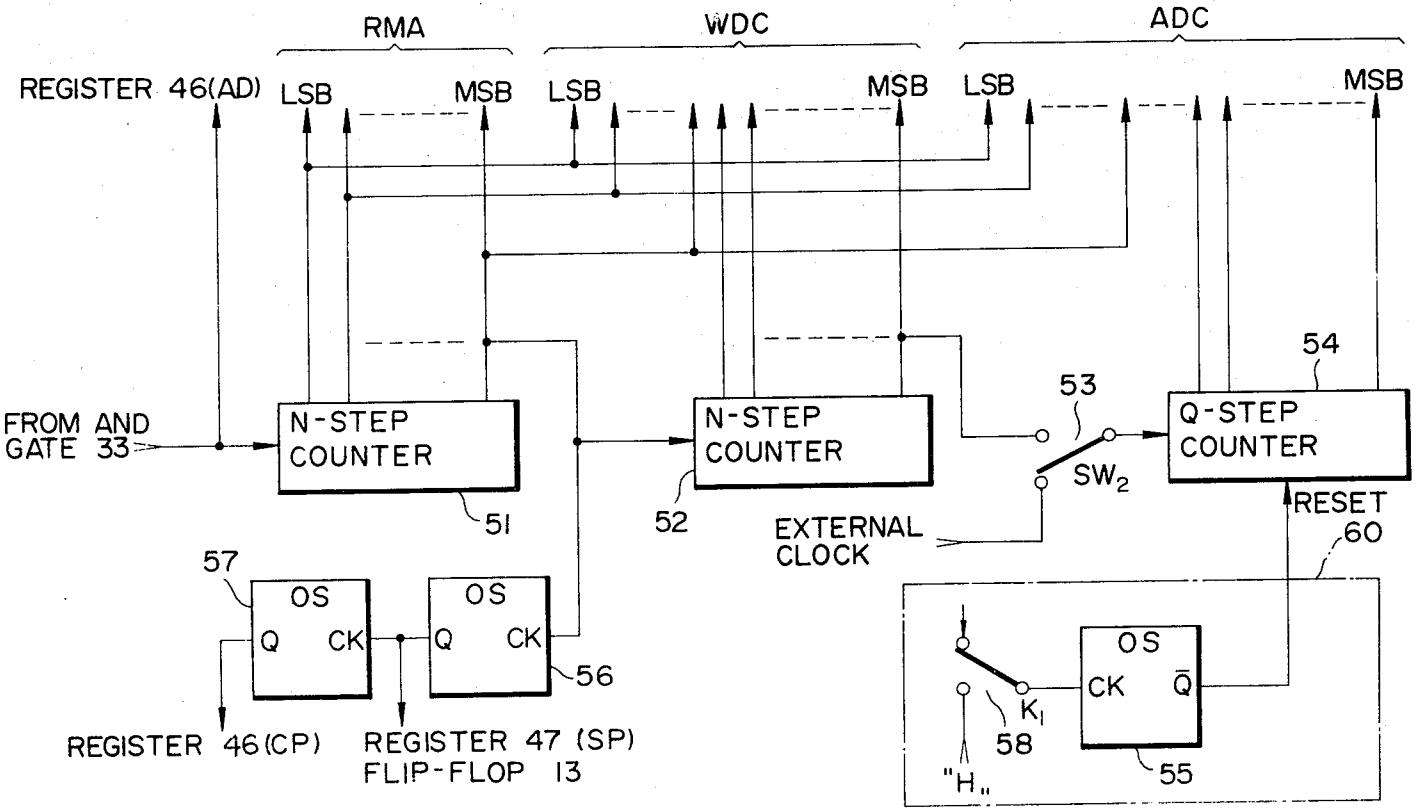
FIGS. 4 and 5 are circuit diagrams illustrating in more detail examples of the principal part of FIG. 3.

FIG. 4 illustrates in detail an example of the circuit structure of the calculation execute program control 34 (see FIG. 3) for the abovesaid calculation. In FIG. 4, n-step counters 51 and 52 are connected in series to each other and connected to a q-step counter 54 through a change over switch ($SW_2$) 53 for switching the most significant bit of the n-step counter 52 and an external clock to each other. The outputs from the respective stages of the n-step counters 51 and 52 and the q-step counter 54 are derived as the signals RMA, WDC and ADC, respectively. The connection point of the n-step counters 51 and 52 is connected to the register 47 and the flip-flop 13 via a monostable multivibrator 56 and to the register 46 via a monostable multivibrator 57. The resetting of the q-step counter 54 is effected by switching the input level of a monostable multivibrator 55 with a key switch ($K_1$) 58. With such a structure, the counters 51, 52 and 54 count with the calculation clock from the AND gate 33 and the respective memories, that is, the coefficient buffer memory, the Walsh Hadamard memory and the $\alpha_n(t)$ memory respectively output the data $Z_n$, $h_{ij}$ and $\alpha_n(t)$ which are calculated in the order of the above equations in accordance with the counter outputs RMA, WDC and ADC. At the same time, there are provided a plant control pulse Ad for the register 46, a reset pulse $C_p$ for the register 46, a plant control pulse $S_p$ for the register 47 and a reset pulse for the flip-flop 13. The changeover switch 53 is a switch for selecting the application of the clock from the most significant bit of the n-step counter 52 to the q-step counter 54 or the counting operation of the counter 54 with the external clock. The q-step counter 54 is used for selecting the set of $\alpha_n(t)$ with the lapse of time and, in this example, it is capable of assigning q sets of $\alpha_n(t)$, so that a waveshape having substantially q kinds of spectrum structures is periodically reiterated.

A one-dot chain line part 60 is used by the key switch 58 to provide a change for a first predetermined period of time (several millisenconds) in the musical sound produced. When the key switch 58 provides "1", the monostable multivibrator 55 reduces its Q output to the lower level to make the q-step counter 54 operable.

The following will describe the second method of calculation of the musical waveshape amplitude in the waveshape calculator utilizing the Walsh Hadamard matrix.

With this method, when to calculate one waveshape amplitude value, for instance, $S_1$, the following Walsh Hadamard matrix of a relatively low degree is used $$[H_m] = [h_{ij}, 1, 2, \ldots, m] \quad h_{ij} = +1 \text{ or } -1 \tag{7}$$

to cause the waveshape amplitude values $S_1, S_2, \ldots S_n$ and the coefficients $Z_1, Z_2, \ldots Z_n$ to each other as follows:

$$\left.\begin{aligned}
\begin{bmatrix} S_1 \\ \vdots \\ S_m \end{bmatrix} &= [H_m] \begin{bmatrix} Z_1 \\ \vdots \\ Z_n \end{bmatrix} \\
\begin{bmatrix} S_{m+1} \\ \vdots \\ S_{2m} \end{bmatrix} &= [H_m] \begin{bmatrix} Z_{m+1} \\ \vdots \\ Z_{2m} \end{bmatrix} \\
\begin{bmatrix} S_{n-m+1} \\ \vdots \\ S_n \end{bmatrix} &= [H_m] \begin{bmatrix} Z_{n-m+1} \\ \vdots \\ Z_n \end{bmatrix}
\end{aligned}\right\} \tag{8}$$

From the equation (8), the procedure for calculating the waveshape amplitudes $S_1, S_2, \ldots S_n$ in reply to the calculation claim signal $\tau_k(k=1,2, \ldots)$ is as follows:

$$\left.\begin{array}{ll}
\tau_1 & S_1 = h_{11}Z_1 + h_{12}Z_2 \ldots + h_{1m}Z_m \\
\tau_2 & S_2 = h_{21}Z_1 + h_{22}Z_2 \ldots + h_{2m}Z_m \\
\vdots & \vdots \\
\tau_m & S_m = h_{m1}Z_1 + h_{m2}Z_2 \ldots + h_{mn}Z_m \\
\tau_{m+1} & S_{m+1} = h_{11}Z_{m+1} + h_{12}Z_{m+2} \ldots + h_{1m}Z_{2m} \\
\vdots & \vdots \\
\tau_n & S_n = h_{m1}Z_{n-m+1} + h_{m2}Z_{n-m+2} \ldots + h_{mn}Z_n \\
\tau_{n+1} & S_1 = h_{11}Z_1 + h_{12}Z_2 \ldots + h_{1m}Z_m \\
\vdots & \vdots
\end{array}\right\} \tag{9}$$

With this method, the procedure for the calculation of one sample value is reduced to 1/m that in the first method described above.

For the second method, in FIG. 3 a switch ($SW_1$) 37 is provided on the input side of the multiplier 41 to change over a contact P on the side of the multiplier 40 to a contact P' which connects the multiplier 40 directly to the coefficient buffer memory 11.

Thus, the procedure can be simplified by omitting the coefficient $\alpha_n(t)$, as shown in the equation (9).

Figure 5:
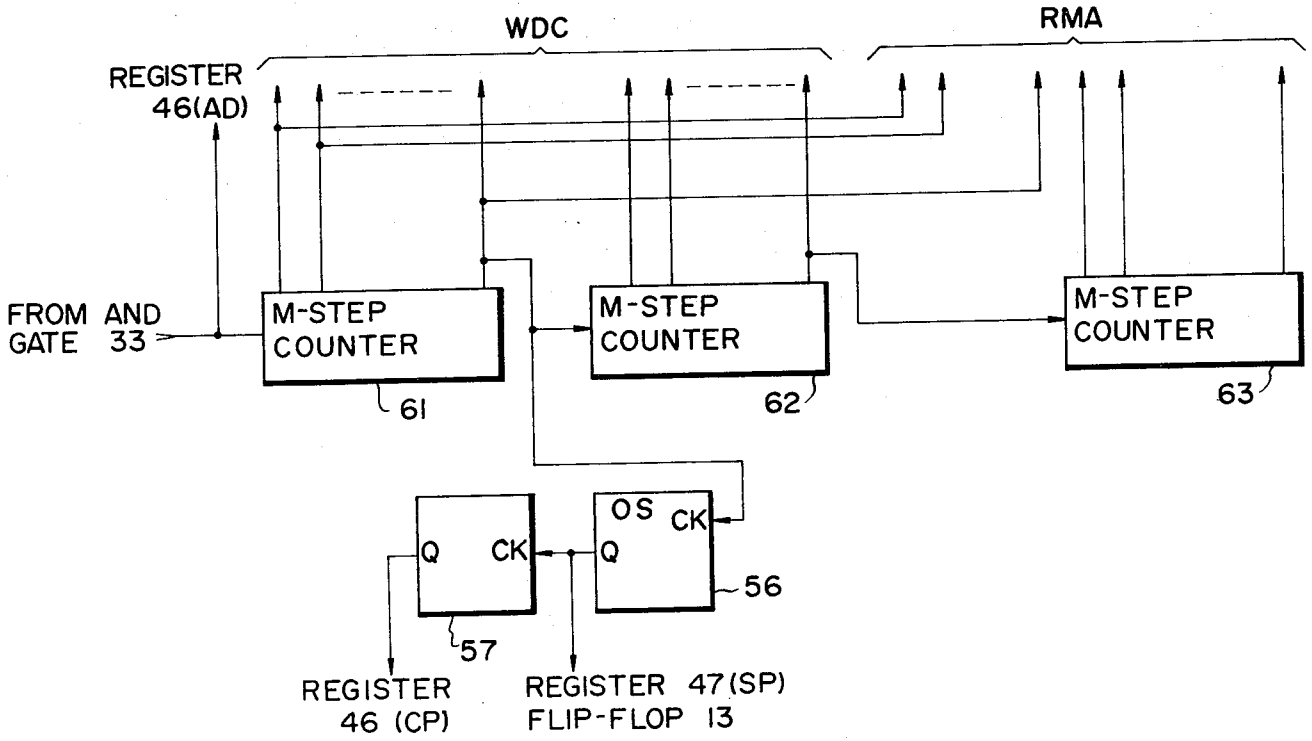

FIG. 5 shows in detail an example of the circuit construction of the calculation execute program control 34 for carrying out the calculation according to the second calculation method. In FIG. 5, the input to the calculation execute program control 34 is applied from the AND gate 33 and m-step counters 61, 62 and 63 are connected in series. The signal WDC is derived from the m-step counters 61 and 62 and the signal RMA from the m-step counter 63. Between the m-step counters 61 and 62 the monostable multivibrators 56 and 57 are connected, as is the case with FIG. 4. The operation of the illustrated calculation execute program control 34 provides substantially the same function as that obtainable with the circuit of FIG. 4 but since the time function is omitted, the circuit structure can be simplified in accordance with the calculation procedure described above.

As explained above, in accordance with this invention, the coefficient corresponding to a tone selected by a tone selector is read out from a memory to calculate a logical orthogonal function, for instance, a composite coefficient of the Walsh Hadamard matrix, and the composite coefficient is applied to a plurality of waveshape calculators to calculate the amplitude value of a required musical waveshape and the electronic musical instrument is actuated at the timing predetermined times the musical period corresponding to the depressed key. With such a structure, by setting coefficients at will, desired musical waveshapes can be obtained and it is also possible to change the spectrum structures of the waveshapes with the lapse of time, as described above. Further, a polyphonic tone synthesis can be achieved by waveshape calculators performing such an intermittent operation as referred to above, by which variegated musical sounds close to those of ordinary musical instruments can be produced with a simple structure.

In the electronic musical instrument of FIG. 1, the key depression detecting and assigning device 2 detects and assigns the key data and the subsequent processing is performed in two systems. In practice, however, a plurality of systems are employed in each of which an envelope generator and a waveshape calculator are provided. The plurality of systems are each constructed to have a close relation to a series of operations concerning a key. The series of operations are those for the generation of the frequency of a required musical note, the generation of the envelope of a musical note such as attack, release, sustain, etc. in reply to key depression and release, the polyphonic tone generation required by the depression of a plurality of keys.

Figure 6:
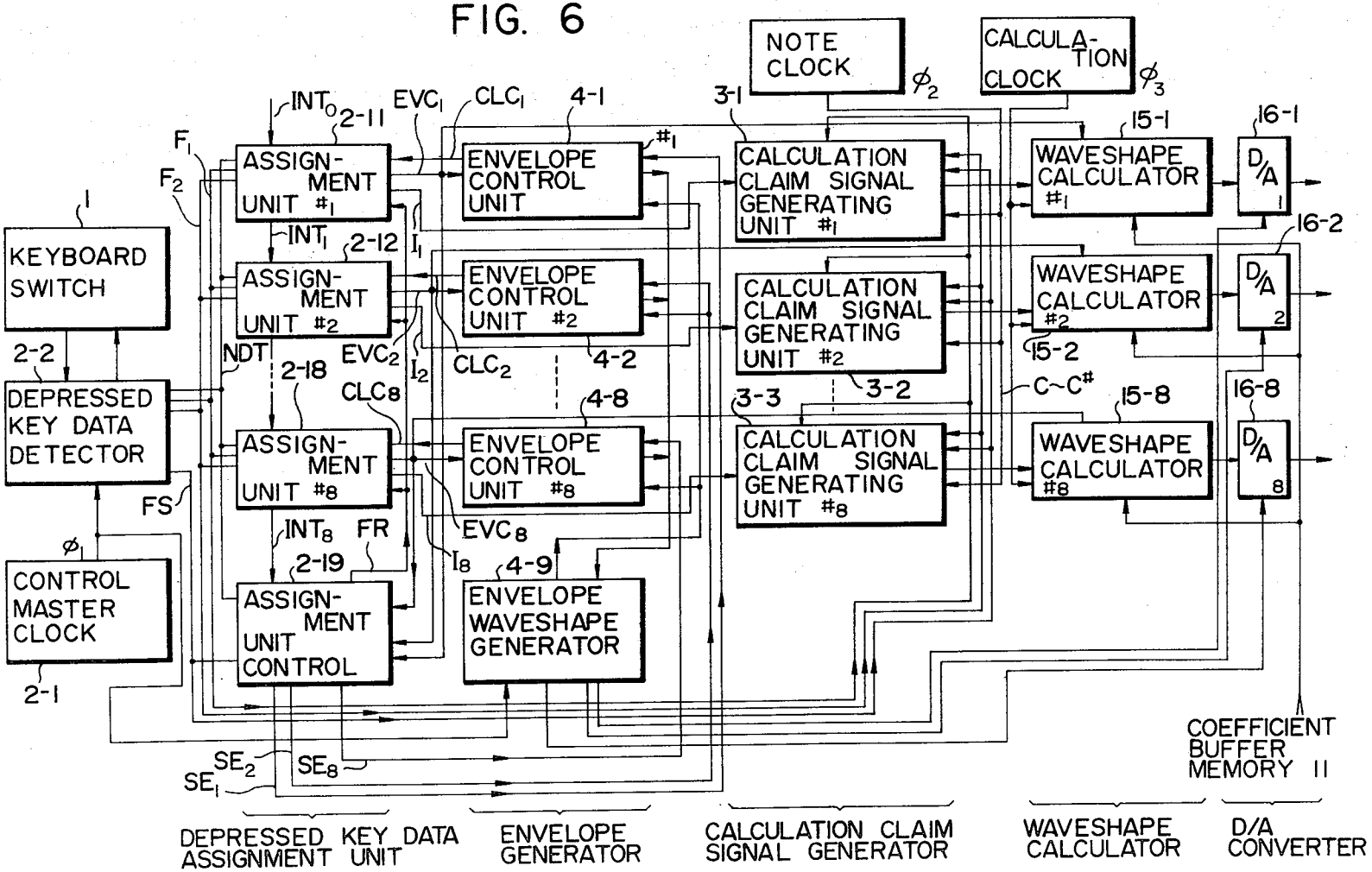
FIG. 6 is a block diagram showing the structures of a plurality of systems for depressed key data detection and assignment in accordance with this invention.

FIG. 6 is a block diagram showing the construction of such a plurality of systems. The keyboard switch 1 is an ON-OFF switch provided or the keyboard. Usually, this switch is constructed to be ON and OFF when depressed and released, respectively, but any type of switch can be used as long as it is capable of representing the two states of key depression and release.

A depressed key data detector 2-2 converts the state of the key switch 1 to an electric signal and, at the same time, detects the state of the key switch 1 on a time shared basis and, in accordance with the state, sends out signals (FS, $F_1$, $F_2$ and NDT) controlling other units. For the generation of these signals, the depressed key data detector 2-2 is supplied with a clock $\phi_1$ from a controlling master clock 2-1.

An assignment unit control 2-19 applies control signals to assignment units (#1) 2-11 to (#8) 2-18 and calculation claim signal generating units (#1) 3-11 to (#8) 3-8. As illustrated, the assignment units 2-11 to 2-18, envelope control units (#1) 4-1 to (#8) 4-8, the calculation claim signal generating units 3-1 to 3-8, waveshape calculators (#1) 15-1 to (#8) 15-8 and D-A converters 16-1 to 16-8 are respectively interconnected to have one to one correspondence to one another. In other words, they are divided into individual unit groups for obtaining musical notes corresponding to keys being depressed, respectively. For example, based on the signal from the depressed key data detector 2-2, one unit group is set up which includes the assignment unit 2-11, the envelope control unit 4-1, the calculation claim signal generating unit 3-1 and the waveshape calculator 5-1. Accordingly, in FIG. 6, eight systems of such unit groups are provided and this means that musical notes corresponding to up to eight keys can be produced simultaneously.

The assignment units 2-11 to 2-18 respectively provide signals $EVC_1$ to $EVC_8$, each indicating the state of key depression or releasing, and send them to the envelope control units 4-1 to 4-8, respectively. The envelope control units 4-1 to 4-8 are responsive to the signals to actuate an envelope generator 4-9, generating an envelope waveshape in analog form. The envelope generator 4-9 applies a signal indicating the state of generation of the envelope, for example, completion of attack, release or the like, to the envelope control units 4-1 to 4-8 to inform the assignment units 2-11 to 2-18 of completion of the envelope generation, i.e. completion of the musical sound generation. Upon reception of such a signal, the envelope control units 4-1 to 4-8 provide assignment unit clear signals $CLC_1$ to $CLC_8$ to clear the assignment units 2-11 to 2-18 in preparation for the next key depression.

The waveshape calculators 15-1 to 15-8 are each actuated by a calculation clock $\phi_3$ to calculate the musical waveshape amplitude from a composite count value, which amplitude is applied in digital form to one of the D-A converters 16-1 to 16-8 for conversion to analog form. The envelope generated by the envelope generator 4-9 is applied as a reference voltage to each of the D-A converters 16-1 to 16-8 to promote the generation of a musical waveshape having an envelope.

The signals $EVC_1$ to $EVC_8$ from the assignment units 2-11 to 2-18, indicating the state of the corresponding keys, respectively, are also provided to the waveshape calculators 15-1 to 15-8 and used as control signals for scaling in accordance with a predetermined program the composite coefficient value for the Walsh Hadamard matrix which is applied to each waveshape calculator from the coefficient buffer memory 11, enabling spectrum variations of a musical note generated with the lapse of time. Further, the assignment units 2-11 to 2-18 supplies the calculation claim signal generating units 3-1 to 3-8 with signals $I_1$ to $I_8$ identifying the keys assigned thereto, respectively.

The control signals FS, $F_2$, $F_1$, ets. are applied as synchronizing signals to the calculation claim signal generating units 3-1 to 3-8 to effect the selection of the note clock $\phi_2$ and other operations, producing the timing for intermittently operating the waveshape calculators 15-1 to 15-8. These principal parts will hereinbelow be described with reference to examples of their circuit constructions.

Figure 7:
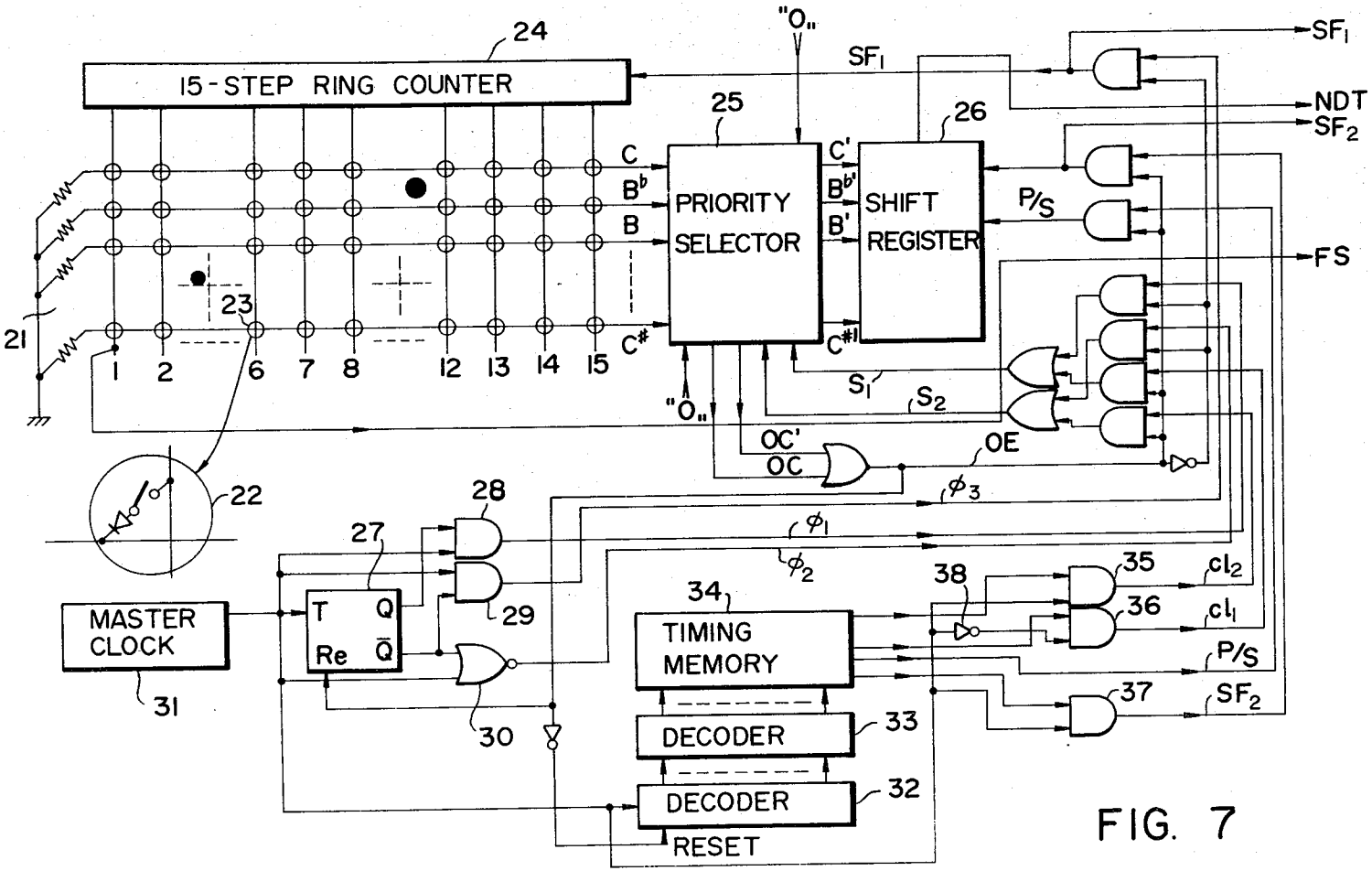
FIG. 7 is a circuit diagram illustrating in detail an example of a depressed key data detector used in FIG. 6.

FIG. 7 illustrates in detail examples of the circuit structures of the key switch 1 and the depressed key data detector in FIG. 6.

As shown in FIG. 7, a switch matrix 21 is composed of twelve rows and fifteen columns. Notes C, B, . . . C# correspond to the twelve rows. Of the fifteen columns, 1 to 6 correspond to each octave of an upper keyboard, 7 to 12 each octave of a lower keyboard and 13 to 15 the octave of a pedal keyboard. If the above arrangement method is used in an ordinary full-scale electronic musical instrument, some of matrix intersections are not used. With such an (n×m) matrix arrangement, however, the structure of hardware used is simplified and, in such a system in which the frame time for the detection of all keys varies with the number of keys being depressed, there is not involved any waste of time due to such unused intersections. A circle indicated by 22 shows the connection of each switch 23 to each bus and, as shown, a diode is inserted for preventing a backward current from other switches. A 15-step ring counter 24 is connected to buses of fifteen columns to intermittently select the columns one after another with a drive clock $SF_1$. A priority selector 25 is connected to buses of twelve rows and outputs simultaneous inputs to terminals C to C# at staggered timings of clocks $S_1$ and $S_2$ and, at the same time, decides whether or not the keys have been selected of one or ones of the columns. A shift register 26 writes therein data C' to C#' in parallel and reads them out at the next timing to send out note data NDT. The other logical circuits in FIG. 7 are to produce operation timings of the present device. That is, the operation of the present device is classified into substantially two fundamental operations. A first one of the two operation is to actuate the 15-step ring counter 25 at the timing provided by AND circuits 28 and 29 and a NOR circuit 30 supplied with a clock from a master clock generator 31 via a T flip-flop 27, thereby to select each column and detect the state of keys in the column. The second operation is as follows: Where at least one of the key switches is closed in the column selected by the ring counter 24, the abovesaid first operation is stopped and predetermined time slots are produced by the priority selector in the order of priority of those of the output buses of the row direction which have key switch closure signals, and pulses having the phase angles corresponding to the rows are generated in the abovesaid time slots for the identification of the rows.

Figure 8:
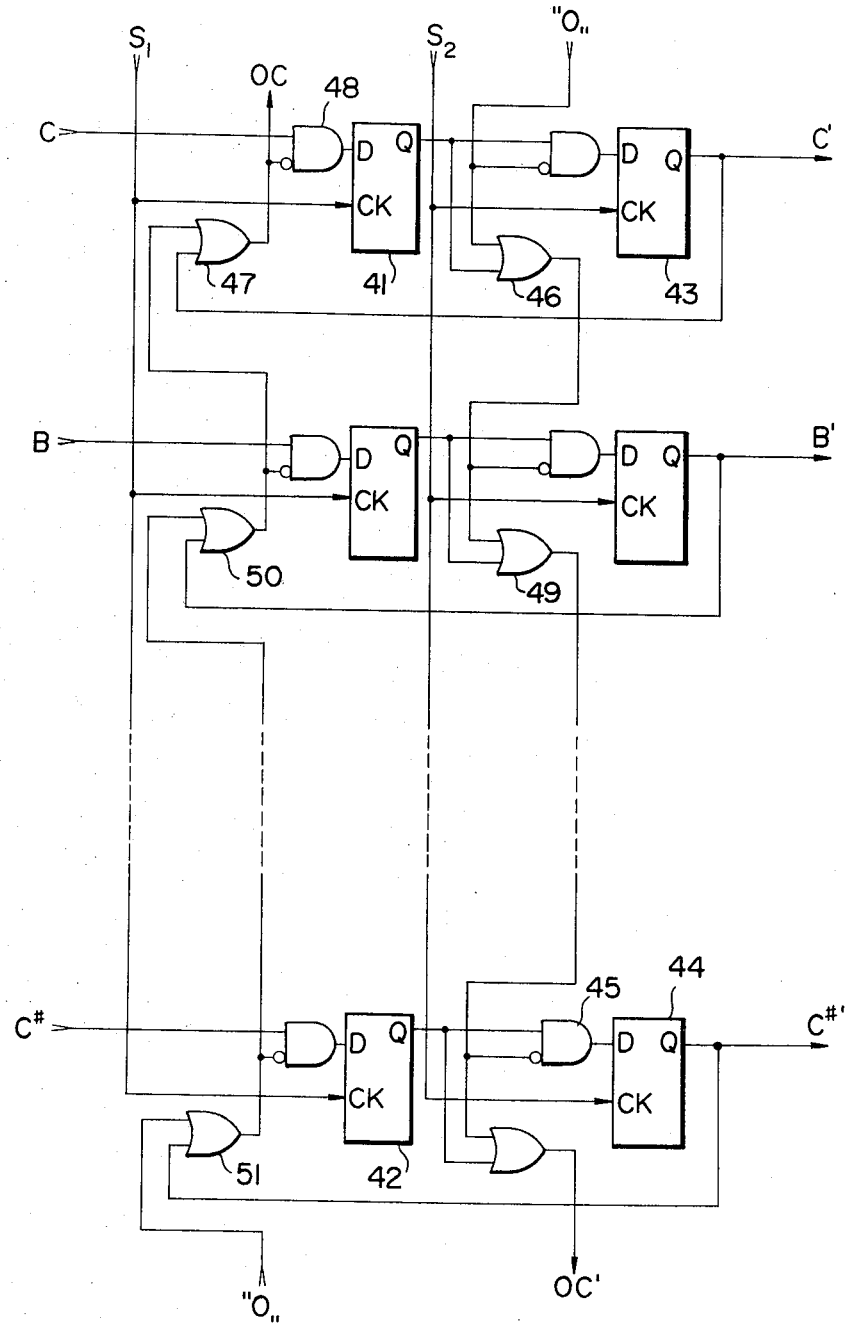
FIG. 8 is a circuit diagram showing in detail an example of a priority selector utilized in FIG. 7.

FIG. 8 shows a specific operative circuit structure of the priority selector 25 in FIG. 7. This circuit is controlled by the clock $S_1$ and its inverted clock $S_2$. Assuming that the note data C and C# are given "1" simultaneoulsy, "1" of the data C and C# are written by the clock $S_1$ in D flip-flops (DFF) 41 and 42, respectively. Then, the output Q from the D flip-flop 41 is applied via OR circuits 46 and 49 to an inhibit gate 45 to close it. Next, the output from the D flip-flop 41 is written by the clock $S_2$ in a D flip-flop 43 but the output from the D flip-flop 42 is inhibited by the inhibit gate 45 from input to a D flip-flop 44. At this time, an inhibit gate 48 is closed by the output from the D flip-flop 43 via an OR gate 47. By the next clock $S_1$, "1" of the data C and C# are to be written again in the D flip-flops 41 and 42 but the signal for the data C is inhibited by the inhibit gate 48 and only the signal for the data C# is written in the D flip-flop 42. Accordingly, "0" is written in the D flip-flop 41. As a result of this, the output Q from the D flip-flop 41 becomes "0" to open the inhibit gate 45 via the OR circuits 46 and 49. Further, at the timing of the next clock $S_2$, the outputs from the D flip-flops 41 and 42 are written in the D flip-flops 43 and 44, respectively, and the output from the D flip-flop 43 provided to the bus C' returns to "0" and the output C#' from the D flip-flop 44 becomes "1". At this time, the output C#' inhibits input to the D flip-flop 42 via an OR circuit 51 and, at the same time, closes the inhibit gate 48 via the OR gates 50 and 47 to inhibit input to the D flip-flop 41. At the timing of the next clock $S_1$, the output C#' from the D flip-flop 44 returns to "0".

Figure 9:
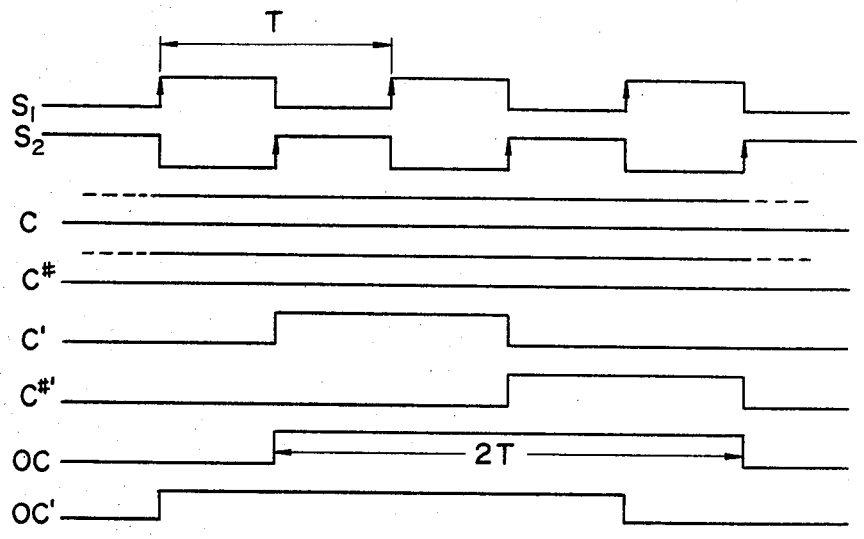

FIG. 9 shows operation waveforms of the priority selector of FIG. 8. In FIG. 9 there are shown the clocks $S_1$ and $S_2$, the note data C, C', C# and C#' and the states of inhibit lines OC and OC' as the inputs and outputs to and from the abovesaid priority selector. Letting the period of the clock $S_1$ and the number of simultaneous inputs be T and K, respectively, the duration of the state "1" of the line BC is KT. In this instance, since K=2, the duration is 2T.

Figure 10:
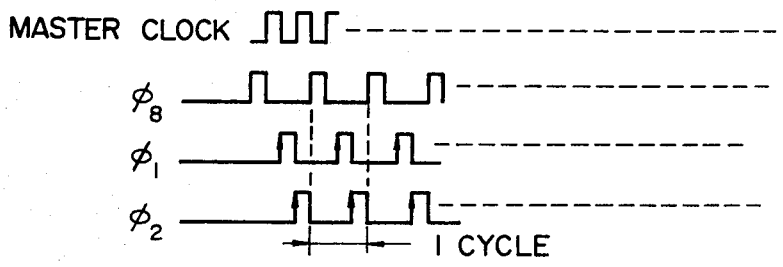

FIG. 10 shows the timing of the first operation described above with regard to FIG. 7.

In the first operation, the clocks $\phi_1$ and $\phi_2$ are provided as the clocks $S_1$ and $S_2$ for input to the priority selector 25 to carry out the operation in the row direction in FIG. 7. At the same time, the clock $\phi_3$ is applied as a drive clock $SF_1$ to the 15-step ring counter 24 to perform the column selection. As depicted in FIG. 10, the clocks $\phi_1$ and $\phi_2$ are provided in one cycle of the clock $\phi_3$. These clocks are produced in the following manner. Namely, the fundamental clock of the master clock generator 31 is applied to the T flip-flop 27 and its Q and $\overline{Q}$ outputs are respectively applied to the AND circuits 28 and 29 together with the fundamental clock to derive therefrom the clocks $\phi_1$ and $\phi_3$, respectively. The clock $\phi_2$ is obtained from the NOR circuit 30 supplied with the $\overline{Q}$ output from the T flip-flop 27 together with the fundamental clock.

FIG. 11 shows the timing of the second operation. The second operation is started when a signal of a line OE produced by applying to an OR circuit the signals OC and OC' of the inhibit lines referred to in respect of FIG. 8 becomes "1", and clocks $cl_1$ and $cl_2$ are provided in reply to the clocks $S_1$ and $S_2$, respectively. At the same time, there are provided a shift clock $SF_2$ of the shift register 26 and a parallel-serial control signal P/S which indicates the timing for parallel input and serial output. The timings of these signals such as shown in FIG. 11 are provided by a counter 32 actuated by the fundamental clock from the master clock generator 31, a decoder 33 and a timing memory 34 formed with a read-only memory having stored therein the timings of the aforesaid signals. In synchronism with the fundamental clock, the clock $cl_2$ from an AND circuit 35 and the clock $cl_1$ from an AND circuit 36 connected to an inverter are provided to the priority selector 25 to actuate it but since the 15-step ring counter 24 stops, the selecting operation in the column direction is stopped. The parallel-serial timing pulse P/S is directly applied to the shift register 26 and the shift clock $SF_2$ is applied through an AND circuit 37, by which the note data in the row direction are detected by pulses indicating their phase positions and derived in the form of serial data.

Turning back to FIG. 7, let it be assumed that a key switch C of the second column and key switches G, E and B♭ of the third column of the switch matrix 21 are depressed.

Upon selection of the second column by the first operation, "1" is produced in the row output bus C and, by the following clock $S_1$, the signal of the line OE is made "1" to reset the flip-flop 27. At the same time, the counter 32 starts counting based on the master clock from the master clock generator 31 and the clocks $cl_1$ and $cl_2$ are provided for the clocks $S_1$ and $S_2$ for input to the priority selector 25, and the parallel-serial timing pulse P/S and the shift clock $SF_2$ are applied to the shift register 26 to carry out the second operation. At this time, the 15-step ring counter 24 for the column selection stops and continues selection of the second column and the output from the priority selector produces "1" in the output bus C' at the timing of the clock $cl_2$. The time in which "1" is produced is used as a time slot for sending out information indicative of the column being selected. The shift register 26 is used for converting row information to the pulse position in this time slot and the position in the row direction is detected as a phase angle by the shift clock $SF_2$ and is sent out in the form of the serial output NDT.

Upon completion of the abovesaid operation, the signal in the line OE becomes "0" and the first operation is restored. Next, the 15-step ring counter 24 is supplied with the clock $SF_1$ to select the third column. This time, "1" is produced in the row buses $B^b$, G and E. With the next clock $S_1$, the signal in the line OE becomes "1" to bring about the second operation. Only the output $B^{b'}$ from the priority selector 25 corresponding to the bus $B^b$ of higher priority than the two other buses becomes "1". In this while, the shift register 26 carries out the aforesaid operation to send out the note data NDT. Then, the outputs from the priority selector 25 corresponding to the buses G and E of lower priority sequentially become "1" to perform similar operations, respectively. Thus, the second operation is completed and the first operation is restored.

Figure 12:
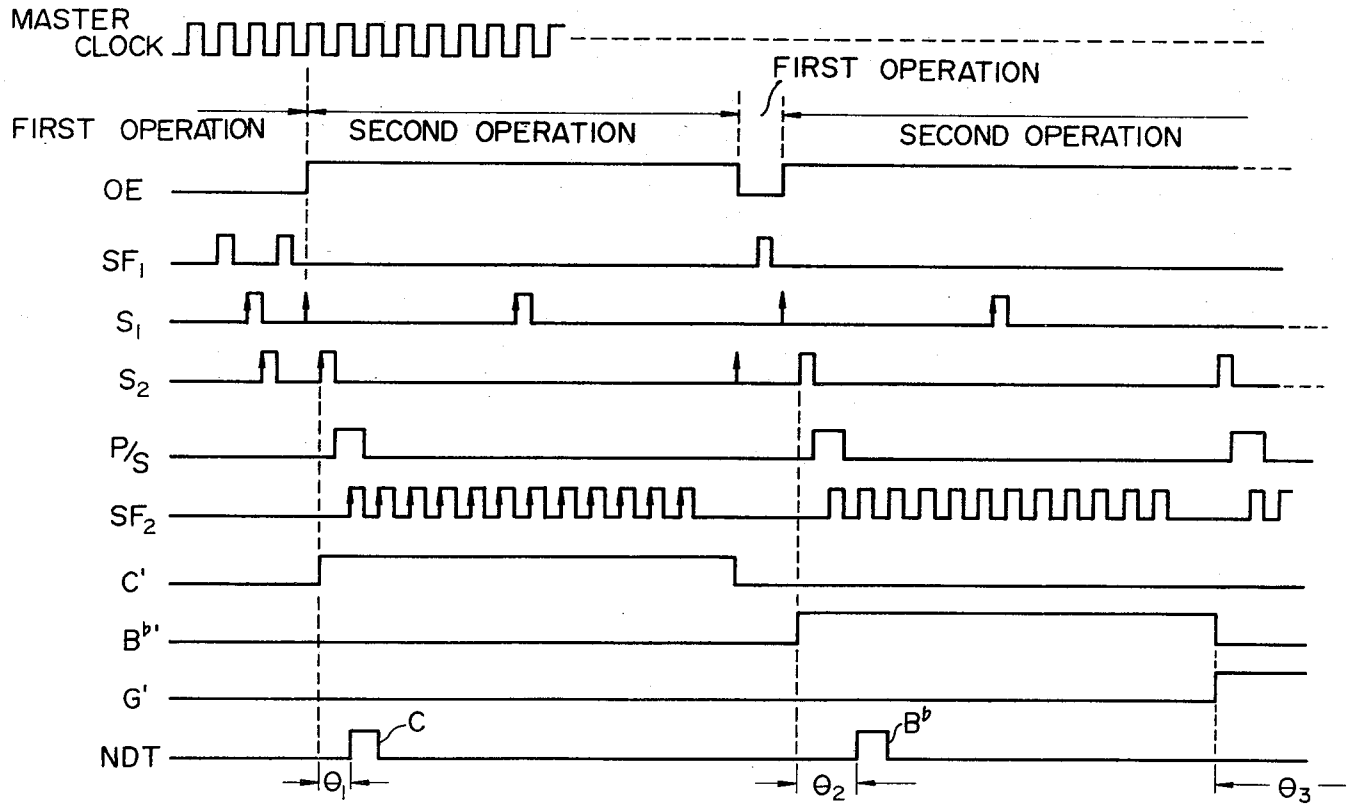

FIG. 12 is a timing chart showing the abovesaid operations. In FIG. 12, $SF_1$ is a column selection clock in the first operation and the signal of the line OE is switched by the clocks $S_1$ and $S_2$ applied to the priority selector to select the first and second operative states, respectively. The parallel-serial timing pulse P/S of the shift register 26 is produced corresponding to the second operative state to provide the shift pulse $SF_2$ corresponding to the octave in the row direction. During the second operation, the notes C, $B^b$, G and E are applied to the shift register 26 as output data C', $B^{b'}$, G' and so on having time slots of such lengths that the shift clock $SF_2$ can be covered with the clocks $cl_1$ and $cl_2$, as shown. In the shift register 26, a pulse is generated by the rise of the pulse of the shift clock $SF_2$ corresponding to the octave in the column set in the first operative state and the phase angle of the generated pulse is detected, by which each note can be identified. Accordingly, as shown by NDT in FIG. 12, the second column is selected by the first operation and, in the second operation, the pulse corresponding to C is detected with the rise of a first pulse of the shift clock $SF_2$ and the phase angle in this case is $\theta_1$. By the next first operation, the third column is selected and, in the second operation, the pulse corresponding to $B^b$ is detected with the rise of a second pulse of the shift clock $SF_2$ and the phase angle in this case is $\theta_2$. The phase angle $\theta_3$ corresponding to G is also detected similarly. In this manner, the depressed key data is detected by the variable frame method and its phase angle is detected without encoding the data into a key code, by which each note can be identified.

The above has described the depressed key data detector and the following will describe the depressed key data assignment unit fit for such key data output.

Figure 13:
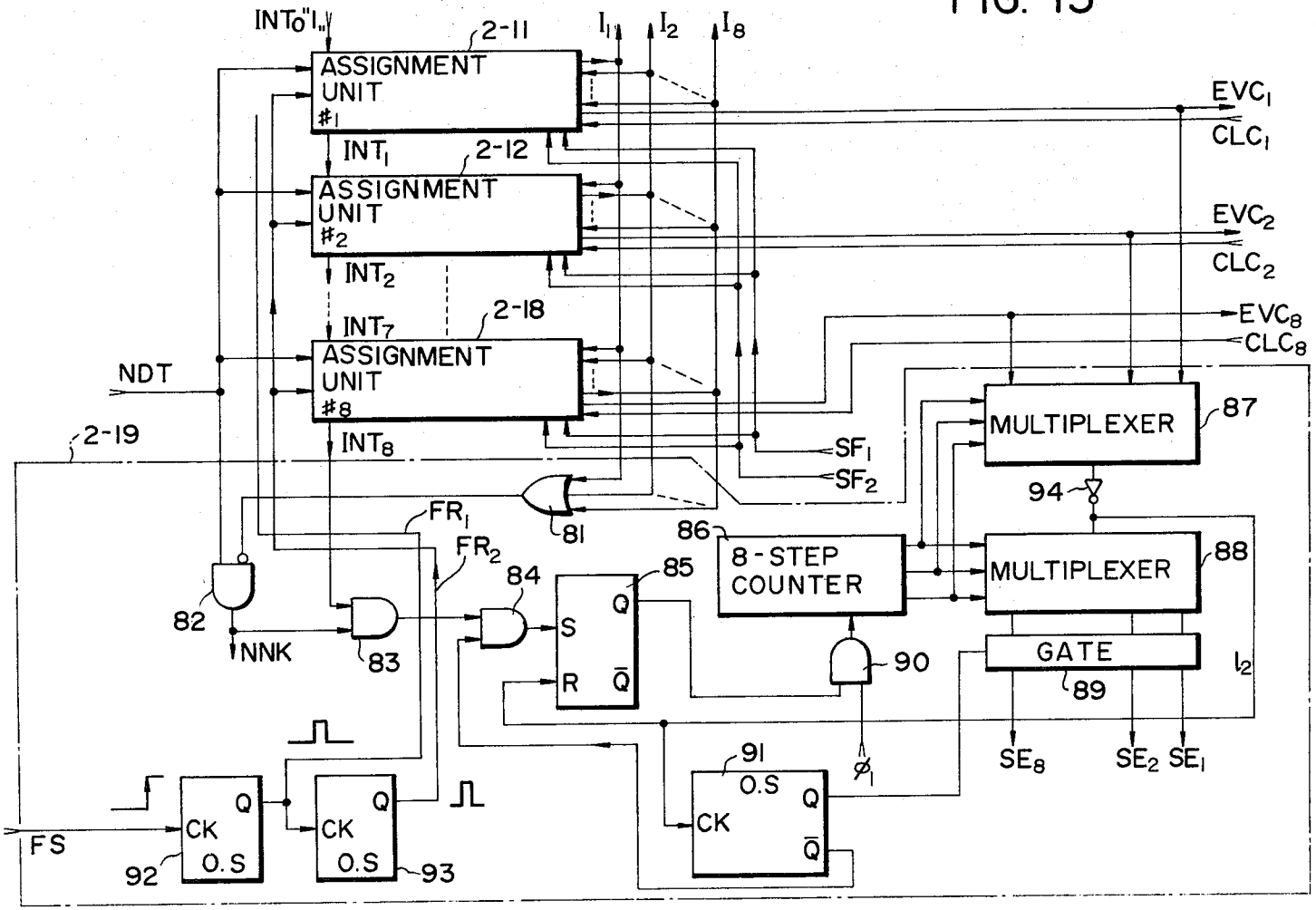
FIG. 13 is a circuit diagram showing in detail an example of a depressed key data assignment unit.

FIG. 13 illustrates in detail the depressed key data assignment unit composed of the assignment units 2-11 to 2-18 and the assignment unit control 2-19 in FIG. 6. In FIG. 13, eight assignment units are shown as in the case of FIG. 6 but the number of assignment units is not limited specifically to eight.

The fundamental function of the depressed key data assignment unit is to receive the drive clock $SF_1$ of the ring counter 24, the shift clock $SF_2$ of the shift register 26, the note data NDT, the frame signal FS, etc. from the depressed key data detector of FIG. 8 and connect them to a plurality of waveshape calculators in the relation of one to one correspondence.

For instance, in such a case where the player depresses two keys C and E of the second octave of the upper keyboard, C and E are respectively assigned to the units 2-11 and 2-12 and control signals $I_1$ and $I_2$ for connecting the waveshape calculators corresponding to the units 2-11 and 2-12 to calculate waveshape amplitudes at the predetermined timing relating to the scale are produced for each unit and sent to associated devices. Further, in this case, the signals $EVC_1$ and $EVC_2$ indicating the state of keys are applied to the associated units so as to indicate the state of the assigned keys (depressed or released), to control the envelope and to cause spectrum variations in the musical sounds to be produced. Upon completion of envelope attenuation resulting from releasing of the assigned keys or the like, the assignment units are cleared by the assignment unit clear signals $CLC_1$ and $CLC_2$ in preparation for the next key assignment.

Figure 14:
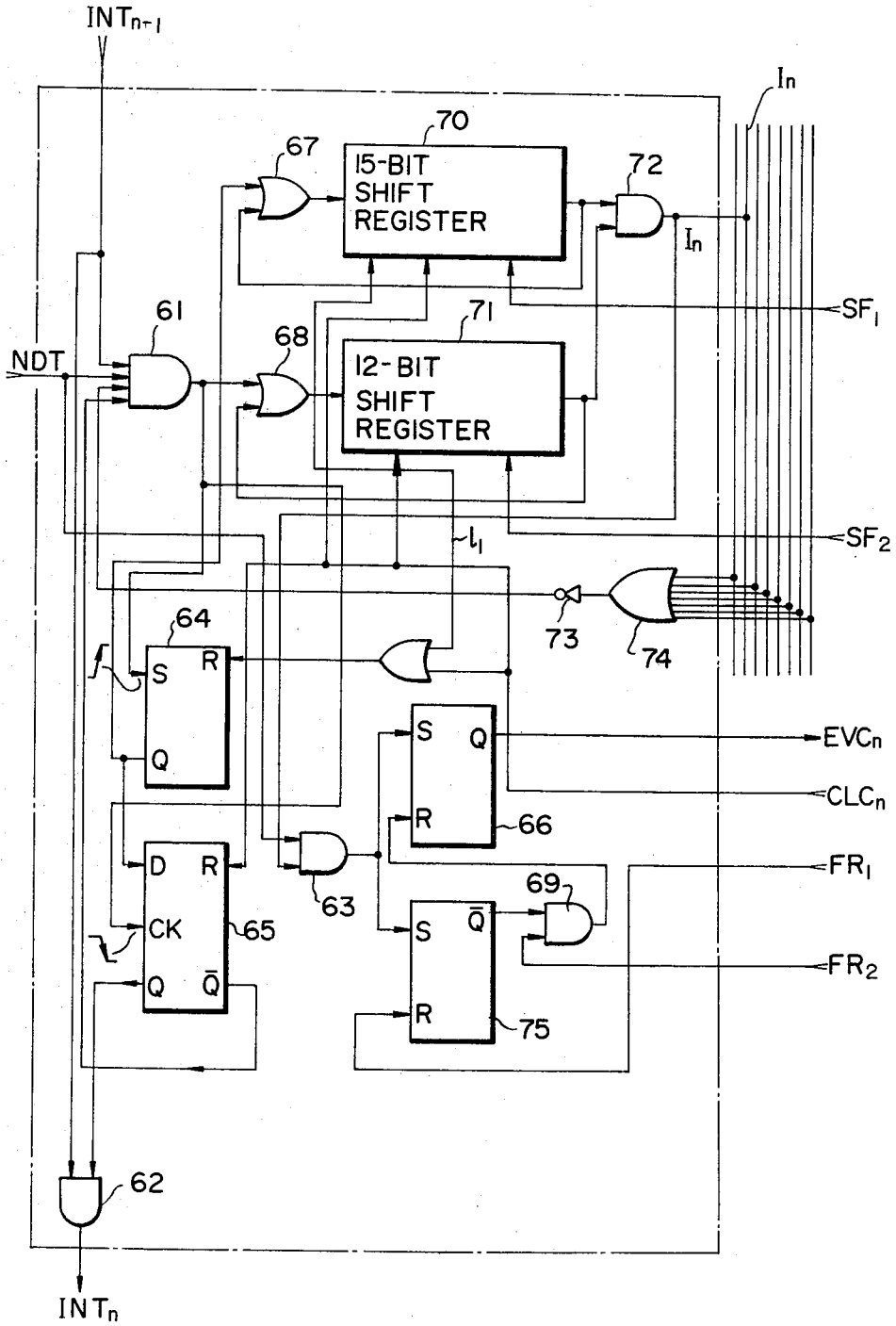
FIG. 14 is a circuit diagram illustrating in detail an example of an assignment unit.

FIG. 14 shows in detail the assignment units 2-11 to 2-18 in FIG. 13. In FIG. 14, the units are identified by #n (n=1 to 8). Assuming that a signal $INT_{n-1}$ from the unit #(n−1) is "1", the signal $INT_{n-1}$ opens an AND circuit 62 and, at the same time, is applied to an AND circuit 61. Further, let it be assumed that a flip-flop 75, a 15-bit shift register 70, a 12-bit shift register 71, a flip-flop 64, a D flip-flop 65 and a flip-flop 66 are in their reset state. In other words, all bits of the serial input-serial output shift registers 70 and 71 are "0" and the outputs Q from the flip-flops 64, 65, 66 and 75 are all "0". Needless to say, the signals $INT_n$, $EVC_n$ and $I_n$ are also "0" in this instance.

Assume that the note data NDT are provided in synchronism with the shift clock $SF_2$. If, now, the key corresponding to the note data NDT is not assigned to the other assignment units, "1" is not produced in the outputs $I_m$ (except $I_n$) from the other units and the output provided from an inverter 73 via an OR circuit 74 is "1" and the output $\overline{Q}$ from the flip-flop 65 is also "1". Next, the note data NDT are sequentially inputted via the AND circuit 61 in synchronism with the shift clock $SF_2$. The note data NDT is a signal having "1" at a predetermined position with respect to the shift clock $SF_2$. When this "1" is inputted, it sets the flip-flop 64 with the rise of its pulse and is applied as the input to the shift register 71 via an OR circuit 68. The output Q from the flip-flop 64 being set is provided to the D flip-flop 65 and, at the same time, applied as the input to the shift register 70 via an OR circuit 67.

Next, with the fall of the pulse of the note data NDT, the output Q from the flip-flop 64, that is, "1", is written in the flip-flop 65. Then, the output Q from the flip-flop 65 becomes "1", which is applied to the AND circuit 62 to make the signal $INT_n$ to the lower-order assignment unit "1". At the same time, the output Q from the flip-flop 65 becomes "0" to close the AND circuit 61.

The 12-bit shift register 71 writes therein "1" from the OR circuit 68 with the shift clock $SF_2$ and the 15-bit shift register 70 writes therein "1" from the OR circuit 67 with the shift clock $SF_1$. At the same time, an output line $l_1$ of the first bit in the shift register 70 becomes "1" to reset the flip-flop 64, altering the input to the shift register 70 to "0".

The shift operation of the shift register 70 is carried out with the shift clock $SF_1$ in synchronism with the column selecting ring counter 24 of the depressed key data detector 2-2 depicted in FIG. 6, while the shift operation of the shift register 71 is achieved with the shift clock $SF_2$ in synchronism with the note data generating shift register 26 of the detecter 2-2.

That is, a key being depressed can be identified according to the bit positions of the two shift registers 70 and 71 at which "1" is written in a specified time. The data written in a specified time. The data written in the shift registers are respectively shifted with the shift clocks $SF_1$ and $SF_2$ in the end-around manner.

Next, a description will be made of the detection of the state (depressed or released) of an assigned key.

The depressed state of the key is detected by a successive comparison of the data, written in the shift registers 70 and 71 by the abovesaid operations, with the note data sognal NDT provided by depression of the key. In other words, the output I from an AND circuit 72, which provides the logical product of the outputs from the shift registers 70 and 71, is AND'ed by an AND circuit 63 with the note data NDT, whereby to detect the depressed state of the key. This can easily be understood from the fact that the shift registers 70 and 71 operate in synchronism with the depressed key data detector 2-2. When the above condition is obtained, the output from the AND circuit 63 sets the flip-flop 66, the output from which is used as the signal $EVC_n$ indicating the state of the key. Also, the flip-flop 75 is set to provide "0" at its output $\overline{Q}$.

The detection of released state of the key is achieved by detecting the case of the abovesaid condition of the AND circuit 63 being not obtained in one frame period of the depressed key data detector 2-2. In other words, upon occurrence of the frame pulse FS from the depressed key data detector 2-2, two one-shot pulses $FR_1$ and $FR_2$ are generated with a time lag therebetween. At first, an AND circuit 69 is cleared with the pulse $FR_1$ and if the output $\overline{Q}$ from the flip-flop 75 is "1" (that is, the case of the AND circuit 63 providing no output), the flip-flop 66 is reset via the AND circuit 69. If the output $\overline{Q}$ from the flip-flop 75 is "0", the flip-flop 66 remains in its set state. Then, the flip-flop 75 is reset by the pulse $FR_2$ to restart the detection of the depressed or released state of the key in the next frame.

Next, a description will be given of the procedure for assignment of the depressed key data. The depressed key data assignment is achieved by setting priority of each assignment unit.

The assignment unit cannot receive the note data signal unless the signal $INT_{n-1}$ is applied to the AND circuit 61 from an assignment unit of higher priority as shown in FIG. 14. When supplied with any depressed key data, the assignment unit applies the signal $INT_n$ to an assignment unit of immediately lower priority.

Accordingly, the depressed key data assignment is achieved with the cascade-connection of such assignments units, as shown in FIG. 13. The signal $INT_0$ to the assignment unit of top priority is made "1", as shown.

In FIG. 13, when the assignment unit 2-11 has written therein specified depressed key data, the signal $INT_1$ becomes "1" and the next new depressed key data is written in the assignment unit 2-12 and the signal $INT_2$ becomes "1" to prepare for writing of the next new depressed key data. If, now, the assignment unit 2-11 is cleared by the clear signal $CLC_1$ which is generated by the envelope termination upon key releasing, the signal $INT_0$ becomes "0" and the next new depressed key data is assigned to the unit 2-11.

In this manner, the depressed key data assignment is accomplished by setting priority of each unit.

Turning now to FIG. 14, a detailed description will be made of the assignment unit control 2-19 surrounded by the one-dot chain line in FIG. 13. This circuit provides the aforesaid one-shot pulses $FR_1$ and $FR_2$ and performs processing in the case of new depressed key data being generated when the assignment units are all occupied. The one-shot pulses $FR_1$ and $FR_2$ are formed by the frame pulse FS from the depressed key data detector in monostable multivibrators (O.S) 92 and 93.

When all the assignment units are occupied, the signal $INT_8$ becomes "1" and the inputs $I_1$ to $I_8$ to an OR circuit 81 become "1" at predetermined timing synchronized with the depressed key data detector 2-2.

An inhibit gate 82 gates with the output from the OR circuit 81 the note data NDT generated at the same moment as the key already assigned. That is, the note data NDT not generated at the same moment indicate depression of a new key. In FIG. 13, the signal is identified as NNK. This signal can be used as a start pulse for various effects of the electronic musical instrument, though not shown.

An AND circuit 83 detects the state that the signals $INT_8$ and NNK become "1", that is, the state that when all the assignment units are occupied, a new key is further depressed by the the player, setting a flip-flop 85 via an AND circuit 84. As a result of this, the master clock $\phi_1$ is applied to an 8-step counter 86, by which a multiplexer 87 operating in synchronism with the counter 86 is caused to retrieve the unit to be cleared. The multiplexer 87 selects the key status signals $EVC_1$ to $EVC_8$ of the respective assignment units one by one. For instance, if the signal $EVC_2$ of the assignment unit 2-12 is "0", that is, if this unit is cleared, "1" is provided in a line $l_2$ via an inverter 94. As a result of this, the flip-flop 85 is reset to stop the counter 86 and a demultiplexer 88 outputs "1" at the corresponding bit. At this time, the monostable multivibrator (O.S) 91 is also supplied with the signal of the line $l_2$, and provides "1" at its output Q for a certain period of time at the same time as "1" is provided in the line $l_2$. The output Q from the monostabel multivibrator 91 clears a gate 89 to make a signal $SE_2$ "1" for the abovesaid certain period of time.

The output $\overline{Q}$ from the monostable multivibrator 91 is applied to the AND circuit 84 to inhibit setting of the flip-flop 85 for the abovesaid certain period of time. With this certain period of time, it is possible to attenuate the envelope corresponding to the assignment unit 2-12 by the signal $SE_2$ at a speed higher than usual and to generate the clear signal $CLC_2$ rapidly. The time for clearing the assignment is suitable to be, for example, about 10 mulliseconds.

Thus, each assignment unit can effectively used by carrying out the processing for a newly depressed key when all the assignment units are used, that is, in an overflow state, as described above.

As described above, the electronic musical instrument of this invention is provided with a depressed key data detector which employs the variable frame method to detect note data not in the form of a key code and which selects the columns of a switch matrix by a ring counter, generates a predetermined time slot in accordance with priority of the rows having key switch closure signals simultaneously provided from a priority selector, produces a pulse having the phase angle corresponding to the row in the time slot and extracts the pulse together with a frame pulse and a clock, thereby to detect key data. Further, the key data thus obtained are assigned to a plurality of assignment units one after another and the pulse having the phase angle is detected from shift registers corresponding to the row and column. Coupled with the use of the logic orthogonal functions for the waveshape calculation, this invention remarkedly simplifies the structure of the electronic musical instrument of the type assigning a plurality of key data of sumultaneously depressed keys to a plurality of assignment units and, thereafter carrying out the waveshape calculation in a plurality of systems.

Figure 15:
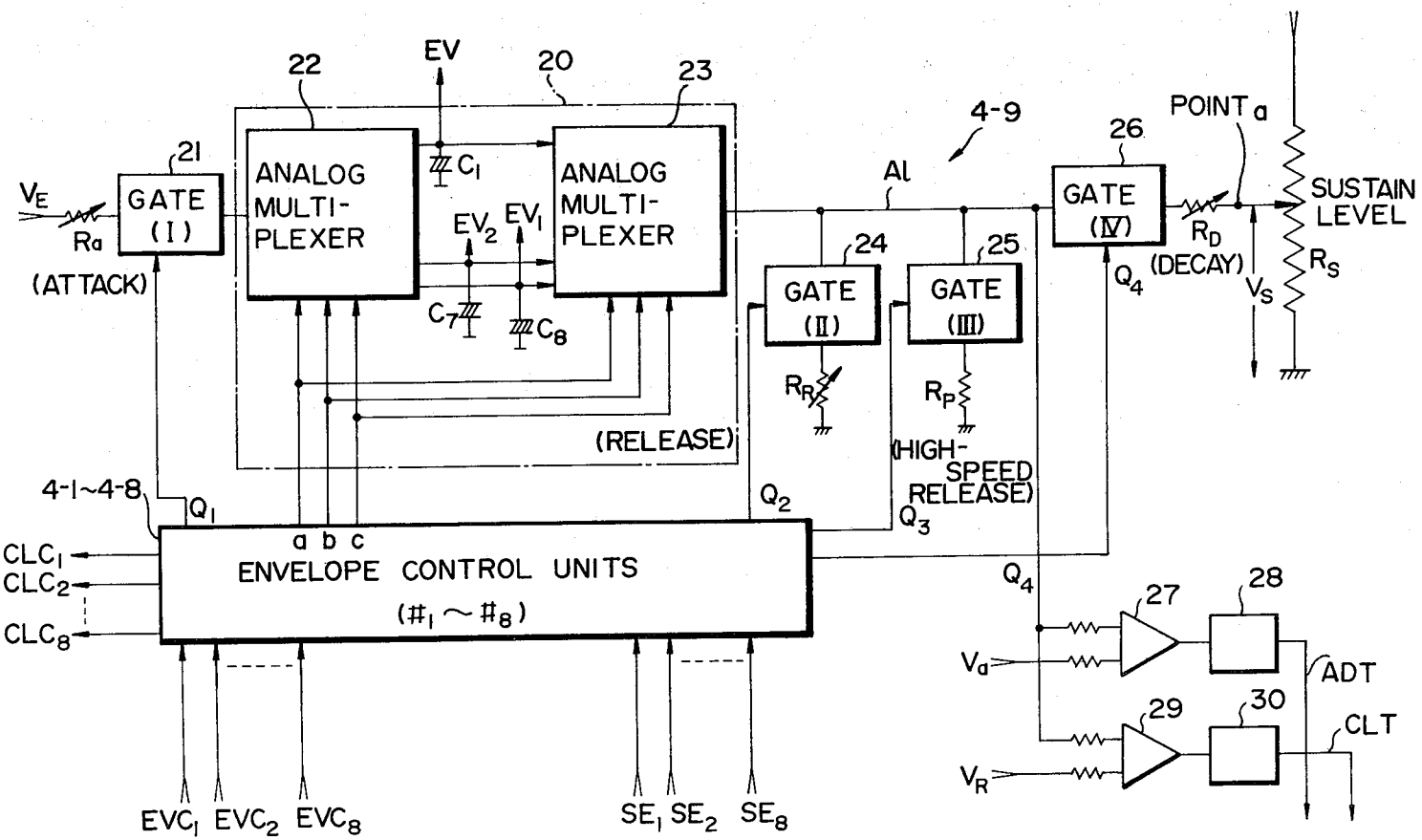
FIG. 15 is a circuit diagram showing in detail an envelope generator utilized in FIG. 6.

FIG. 15 is a detailed circuit diagram showing an example of the envelope generator depicted in FIG. 6. In FIG. 15, one envelope waveshape generator 4-9 is controlled on a time shared basis by the envelope control units 4-1 to 4-8 corrresponding to the aforesaid eight systems.

The envelope waveshape generator 4-9 has a time-sharing switching unit 20 surrounded by the one-dot chain line, in which paths respectively corresponding to the envelope control units 4-1 to 4-8 are provided between an analog multiplexer 22 and an analog demultiplexer 23 supplied with control signals a, b and c from the envelope control units 4-1 to 4-8 and capacitors $C_1$ to $C_8$ are respectively inserted between the paths and the ground. The analog multiplexer 22 and the analog demultiplexer 23 connect on a time shared basis and at high speed the capacitors $C_1$ to $C_8$ to a resistance network provided between the power source and the ground with the control signals a, b and c. Consequently, the capacitors $C_1$ to $C_8$ are each cyclically connected to the resistance network. This means that a time slot is provided for each capacitor. The resistance network comprises a pair of an analog gate (I) 21 and a variable resistor $R_A$ for the attack use which is connected in series between the power source $V_E$ and the analog multiplexer 22, a pair of an analog gate (II) 24 and a variable resistor $R_R$ for the release use and a pair of an analog gate (III) 25 and a variable resistance $R_P$ for the high-speed release use which are respectively connected in parallel to the output of the analog demultiplexer 23 and a variable resistor $R_S$ of a potentioneter for setting a sustain level which is connected in series to the output of the analog multiplexer 23 via an analog gate (IV) 26 and a variable resistor $R_D$ for the decay use. The variable resistors $R_A$, $R_R$, $R_P$ and $R_D$ are controlled by control signals $Q_1$, $Q_2$, $Q_3$ and $Q_4$ provided from the envelope control units 4-1 to 4-8, respectively.

With such an arrangement, in the case of an attack, a time slot is set up by the time constant which is determined by the power source $V_E$, the capacitor $C_n$ corresponding to an nth one of the control units) and the variable resistor $R_A$, and the amount of increase in the potential of the capacitor $C_n$ in the time slot is determined. At this time, the analog gate 21 is conductive and the other analog gates 24, 25 and 26 are set to be non-conductive. That is, in this instance, at the time corresponding to the abovesaid time slot, only the control signal $Q_1$ becomes "1" to conduct the analog gate 21 only. The time slot for the capacitor $C_n$ is periodically provided several times and, upon each ocurrence of the time slot, the potential of the capacitor $C_n$ increases. That is, the potential of the capacitor $C_n$ exponentially increases towards the voltage $V_E$, as shown in the attack in FIG. 16. In this case, a line Al in FIG. 15 is connected to the capacitors $C_1$ to $C_8$ and the analog demultiplexer 23 on a time shared basis, so that the potentials of the capacitors $C_1$ to $C_8$ repetitiously appear in the line Al one after another. A level comparator 27 compares each of the abovesaid potentials with a voltage Va lower than the power source voltage $V_E$. The voltage Va is the highest potential of the envelope waveshape produced. The level comparator 27 provides "1" or "0" on a line ADT via a logical interface 28 depending upon whether each potential on the line Al is higher or lower than the voltage Va.

When the potential of the capacitor $C_n$ exceeds the voltage Va, "1" is provided on the ADT in the time corresponding to the time slot for the capacitor $C_n$. As a result of this, the envelope control unit corresponding to the capacitor $C_n$ responds to the signal "1" to produce a control signal for controlling the envelope in preparation for the generation of a decay.

The decay is provided by discharging charges stored in the operation of the attack through the variable resistors $R_D$ and $R_S$. In this case, only the analog gate 26 becomes conductive and the other analog gates 21, 24 and 25 are set to be non-conductive. In other words, in the time when the time slot corresponding to the capacitor $C_n$ exists, only the control signal $Q_4$ is "1" and the other control signals, $Q_1$, $Q_2$ and $Q_3$ are "0". In this while, the voltage Va is applied to the variable resistor $R_S$ for the sustain use, the potential at its voltage dividing point a is a sustain voltage $V_S$. That is, as indicated in the decay in FIG. 16, the potential of the capacitor $C_n$ exponentially drops to the potential $V_S$ as the abovesaid discharge proceeds.

Figure 16:
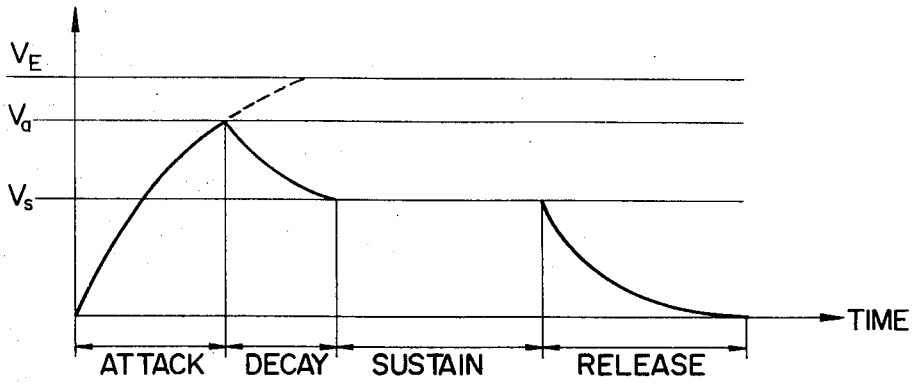
FIG. 16 is a diagram explanatory of an envelope waveshape in FIG. 15.

When the potential of the capacitor $C_n$ reaches the sustain voltage $V_S$, the discharge substantially stops to set up the constant level $V_S$, providing the sustain, as depicted in FIG. 16. In the next release, only the analog gate 24 is made conductive and the other analog gates 21, 25 and 26 are set to be non-conductive. The charges stored in the capacitor $C_n$ are discharged through the variable resistor $R_R$ to form the release. At this time, a drop of the potential of the capacitor $C_n$ to a potential $V_R$ very close to the ground potential (GND) is detected by a level comparator 29 connected to the line Al, providing "1" on a line CLT via a logical interface 30 in the time of the time slot for the capactor $C_n$. This signal is used for indicating that the musical note produced has been substantially released.

The above description has been given in connection with a typical envelope waveshape but this invention is not limited specifically thereto but is also applicable to various other modified envelope waveshapes.

Next, a description will be made of the envelope control device for relating the envelope generation process of the envelope waveshape generator 4-9 to the key.

As referred to above, the envelope waveshape generator 4-9 of FIG. 15 is utilized by the control units 4-1 to 4-8 on a time shared basis to set the attack, decay, sustain and release with the control signals $Q_1$ to $Q_4$ from the analog gates 21, 24, 25 and 26, respectively.

Figure 17:
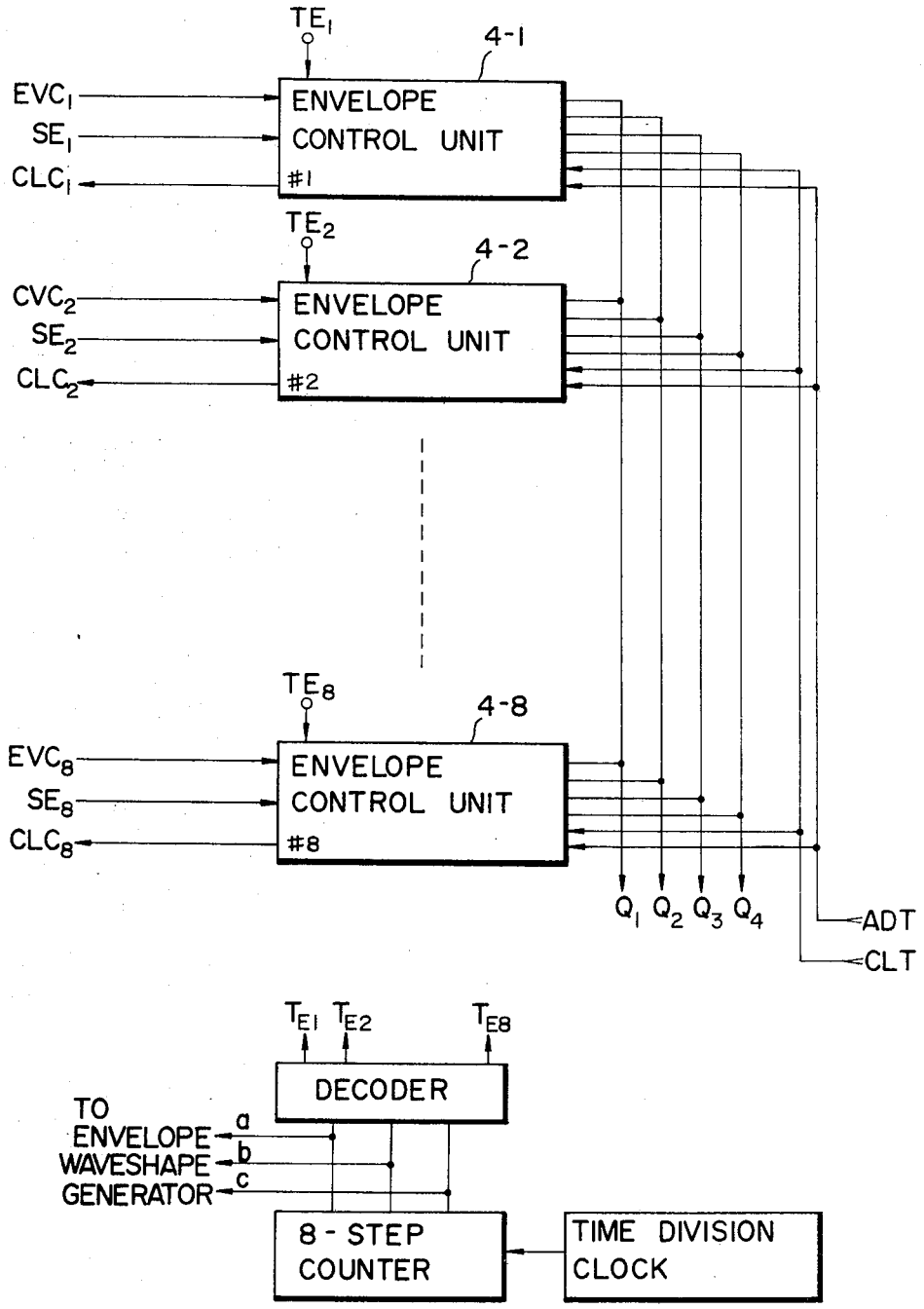
FIG. 17 is a connection diagram of each envelope control unit.

FIG. 17 illustrates the connection of the envelope control units 4-1 to 4-8. The envelope control units 4-1 to 4-8 are respectively supplied with the key status indicating signals $EVC_1$ to $EVC_8$ from the assignment units 2-11 to 2-18 and the signals $SE_1$ to $SE_8$ for releasing the envelope at high speed.

From the envelope waveshape generator 4-9, the envelope control units 4-1 to 4-8 are supplied with the signal ADT indicating that the attack has reached the predetermined voltage value and the signal CLT that the envelope has been sufficiently released. These signals ADT and CLT are applied as time-division multiplexed signals.

The envelope control units 4-1 to 4-8 respectively produce the control signals $Q_1$ to $Q_4$ in reply to the abovesaid signals and provide envelope control signals on the buses of the control signals $Q_1$ to $Q_4$ at their respective time-division timings ($T_{E1}$ to $T_{E8}$), respectively.

Figure 18:
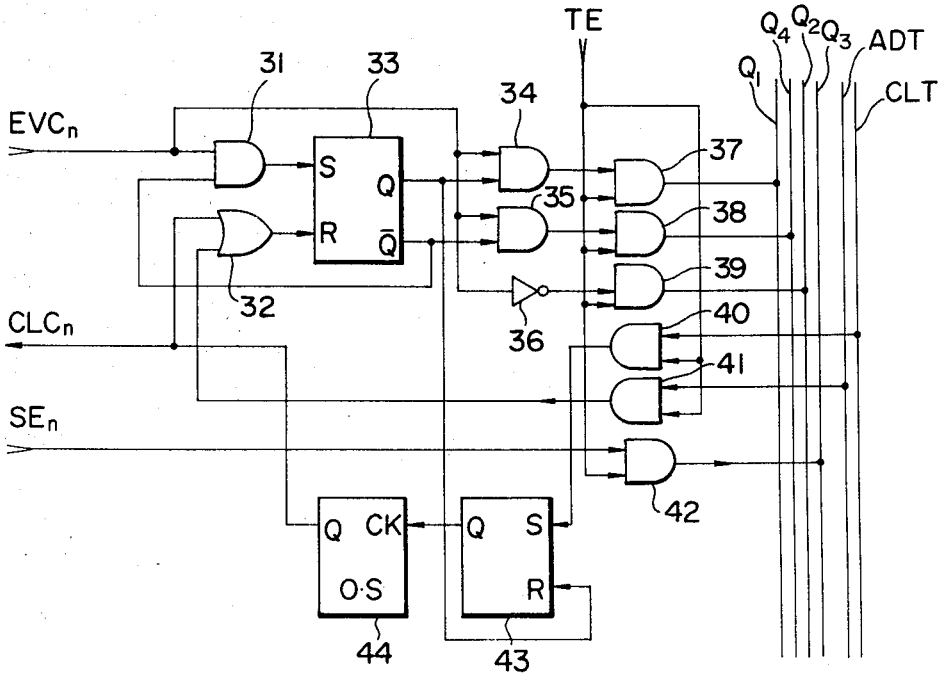
FIG. 18 is a circuit diagram showing in detail an example of an envelope control circuit.

FIG. 18 shows a detailed circuit diagram of an example of the envelope control unit. In FIG. 18, when the key status indicating signal $EVC_n$ from the assignment unit #n becomes "1", a flip-flop 33 is set via an AND circuit 31, so that the output $\overline{Q}$ of the former becomes "0" to close the latter. As a result of this, the input signal EVC to an AND circuit 34 is "1" and the output Q from the flip-flop 33 is also "1", and consequently the output from the AND circuit 34 becomes "1". At this time, an AND circuit 35 and an inverter 36 provide "0". Accordingly, the outputs from the AND circuits 34 and 35 and the inverter 36 are applied to AND circuits 37, 38 and 39, respectively. And since an envelope release signal $S_{En}$ is "0" during the attack, it is applied to an AND circuit 42. The AND circuits 37, 38, 39 and 40 are caused to output at the time-division timing $T_{En}$, by which only the AND circuit output $Q_1$ is made "1", forming the attack.

When the envelope waveshape generator 4-9 forms the attack to reach the valtage Va, the AND circuit 37 provide "1" on the output ADT line at the timing $T_{En}$, which signal "1" is applied to an AND circuit 41 to reset the flip-flop 33 via an OR circuit 32. As a result of this, the output $\overline{Q}$ from the flip-flop 33 becomes "1" and if the signal $EVC_n$ is "1", an AND circuit 35 provides "1" on the output $Q_4$ line via the AND circuit 38 at the timing $T_{En}$. In this case, the output $Q_1$, $Q_2$ and $Q_3$ are "0" at the timing $T_{En}$ and the envelope waveshape generator starts the operation of forming the decay. After the decay, the envelope becomes constant at the sustain level.

Then, when the signal EVC becomes "0", that is, when the key is released, "1" is provided on the output $Q_2$ line via an inverter 36 and the AND circuit 39 at the timing $T_{En}$, providing the release state of the envelope.

If an envelope release signal $S_{En}$ becomes "1" at this time, the outputs $Q_2$ and $Q_3$ are made "1" via the AND circuit 42 at the timing $T_{En}$ to provide a high-speed release state, rapidly releasing the envelope.

As the release proceeds to reach the voltage $V_R$, "1" is produced on the line CLT at the timing $T_{En}$ to set a flip-flop 43 via the AND circuit 40. The output from the flip-flop 43 is applied to a monostable multivibrator 44 to derive therefrom a one-shot pulse, which is sent out as the clear signal $CLC_n$ for resetting the flip-flop 43 and the assignment unit corresponding to the envelope control unit, thus completing a series of envelope control operations.

As described above, in accordance with this invention, a plurality of capacitive elements, for instance, capacitors, are provided corresponding to a plurality of envelope control units and are switchingly connected to an external resistance network on a time shared basis, by which envelopes can be supplied in parallel to a plurality of systems corresponding to a plurality of note data of simultaneously depressed keys at time-division timing. In this instance, the capacitors are each provided for one system but since the resistance network is common to all the systems, the structure can be simplified. In the envelope generator of this invention, as shown in FIG. 15, when envelopes are supplied in parallel to the assignment units, the voltages $EV_1$ to $EV_8$ of the capacitors $C_1$ to $C_8$, and when to extract the envelope signal on a time shared basis, it is picked up from the line Al.

Further, since the attack, decay, sustain and release of the envelope are provided using variable resistors common to all the control units, as mentioned above, there is the advantage that adjustment of the attack, decay, sustain and release can be achieved by adjusting only the variable resistors.

It will be apparent that many modifications and variations may be effected without departing from the scope of the novel concepts of this invention.

What is claimed is:

1. An electronic musical instrument comprising:

a first memory for storing coefficients for a plurality of tones in coded form;

a circuit for reading out required ones of the coefficients from the first memory and for calculating composite coefficients for logic orthogonal functions so as to provide a tone selected by a tone selector;

a second memory for temporarily storing the calculated composite coefficients and sequentially sending them to a plurality of waveshape calculators;

a plurality of waveshape calculators for calculating amplitude values of a required tone waveshape from the composite coefficients supplied from the second memory;

means for intermittently actuating the plurality of waveshape calculators at a frequency which is greater than the musical note frequency corresponding to a key being depressed;

D-A converters for converting to analog form the amplitude values calculated by the waveshape calculators and represented in digital form;

a circuit for producing a musical note having an envelope corresponding to depression and releasing of a key;

an envelope generator having means for switchingly connecting a plurality of capacitive elements to the resistance network on a time shared basis in reply to depression and releasing of a plurality of keys to control charging and discharging of the capacitive elements, thereby forming an envelope, wherein the resistance network is composed of variable resistors for setting an attack speed, a decay speed and a sustain level, respectively, and wherein the connecting means is composed of analog gate circuits, each selecting one of the variable resistors and switching it to another on a time shared basis, and which further includes means for detecting that the envelope has attenuated down to a preset voltage level, and means for indicating an attack level to have reached a predetermined voltage.

2. An electronic musical instrument comprising:

a first memory for storing in digital form a plurality of sets of coefficients of logic orthogonal functions for a plurality of tones;

an adder for adding some of the sets of coefficients selected by a tone selector into a composite set of coefficients;

a second memory for temporarily storing the computed composite set of coefficients; and waveshape calculating means and calculation request means for calculating the amplitude of a musical note waveshape at one sample point at a frequency calculation rate higher than at least the note frequency and independent of the musical note frequency in response to a request for calculation, the calculating means stopping upon each calculation of the amplitude value and not calculating the amplitude value at the subsequent sample point until the next request for calculation is provided, and in which the musical note period is established by providing the request for calculation repetitively at a rate proportional to the musical note frequency, said calculating means further comprising:

a third memory having a first timing means for sequentially writing therein the coefficients of the second memory and a second timing means for reading therefrom the coefficients for the waveshape amplitude calculation;

a fourth memory for storing n order logic orthogonal functions;

a first multiplier for multiplying data from the third and fourth memories;

means for accumulating a predetermined number of results of multiplication from the first multiplier;

means for producing a signal indicating the completion of the calculation of the waveshape amplitude at one sample point;

a register for holding one already calculated amplitude value while the waveshape calculation is suspended; and a D-A converter for converting the calculated amplitude value in digital form to an analog quantity.

3. An electronic musical instrument according to claim 2, which further comprises a second multiplier for scaling with time the coefficients stored in the third memory, and a fifth memory having stored therein scale factors for the respective coefficients, and wherein the spectral structure of a musical tone generated with time in response to key depression and release is changed.

4. An electronic musical instrument according to claim 2, wherein an n order logic orthogonal function is stored in the fourth memory for generating a musical note having n sample points in one period, and wherein a plurality of sets of n coefficients are stored in the first memory.

5. An electronic musical instrument according to claim 2, wherein the n order logic orthogonal function stored in the fourth memory is expressed by a matrix $Hn=[h_{ij}:ij=1, 2, \ldots n]$ where $hij=-1$ or $+1$.

6. An electronic musical instrument according to claim 2, which further comprises means for reading $h_{kj}:j=1, 2, \ldots m$, $h_{kj}-1$ or $+1$ from the fourth memory when calculating the amplitude Sk at a kth sample point using the logic orthogonal function, and an accumulator for accumulating the results of multiplications of the n composite coefficients Zn stored in the third memory and the $h_{kj}$ by the first multiplier, $h_{k1}\times Z_1$, $h_{k2}\times Z_2$, . . . $h_{kn}\times Z_n$ to calculate $$S_k = \sum_{n=1}^{n} k_{km} \times Z_n.$$

7. An electronic musical instrument according to claim 2, which further comprises a flip-flop which is reset by a signal indicating completion of the calculation of the waveshape amplitude at one sample point and is set by a request-for-calculation signal, and means for inhibiting the application of a calculation signal to the waveshape calculator by the output from the flip-flop to ensure the intermittent operation for the waveshape calculation.

8. An electronic musical instrument according to claim 2, which further comprises a plurality of waveshape calculators, each independently calculating the waveshape amplitude at a sample point in accordance with the request for calculation, thereby to generate a polyphonic note.

9. An electronic musical instrument according to claim 2, wherein n capacitive elements (n being an integer$\geqq$2) for n keys and a set of resistor circuits for defining the envelope configuration are coupled together at high speed time-sharing to n channels, thereby to generate n envelopes.

10. An electronic musical instrument according to claim 9, wherein the resistor circuits are each composed of a variable resistor for setting the attack time, a variable resistor for setting the decay time, a variable resistor for setting the sustain level and a variable resistor for setting the release time.

11. An electronic musical instrument according to claim 9, which further comprises means for selectively turning ON and OFF gate circuits respectively connected to the variable resistors in accordance with the key releasing state.

* * * * *